US010909935B2

(12) United States Patent
Koo et al.

(10) Patent No.: US 10,909,935 B2
(45) Date of Patent: Feb. 2, 2021

(54) LIQUID CRYSTAL DISPLAY DEVICE AND METHOD OF DRIVING THE SAME

(71) Applicant: SAMSUNG DISPLAY CO., LTD., Yongin-si (KR)

(72) Inventors: Jahun Koo, Asan-si (KR); Jinho Park, Suwon-si (KR); Jong Deuk Moon, Yongin-si (KR); Su-Han Woo, Asan-si (KR); Kyung-Hun Lee, Yongin-si (KR); Kyung-Uk Choi, Gunpo-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 21 days.

(21) Appl. No.: 16/506,154

(22) Filed: Jul. 9, 2019

(65) Prior Publication Data

US 2020/0066215 A1 Feb. 27, 2020

(30) Foreign Application Priority Data

Aug. 22, 2018 (KR) ..... 10-2018-0098219

(51) Int. Cl.
*G09G 5/10* (2006.01)
*G09G 3/34* (2006.01)
*G09G 3/36* (2006.01)

(52) U.S. Cl.
CPC ..... *G09G 3/3426* (2013.01); *G09G 3/3607* (2013.01); *G09G 2320/0247* (2013.01);
(Continued)

(58) Field of Classification Search
CPC ..... G09G 3/3426; G09G 3/3607; G09G 2320/0247; G09G 2320/064
(Continued)

(56) References Cited

U.S. PATENT DOCUMENTS

2010/0085477 A1 4/2010 Ooishi et al.
2012/0169698 A1* 7/2012 Park ..... G09G 3/3648 345/211
(Continued)

FOREIGN PATENT DOCUMENTS

KR 1020170028479 3/2017
KR 1020180027178 3/2018
KR 1020180039232 4/2018

OTHER PUBLICATIONS

Partial European Search Report dated Jan. 21, 2020 in the corresponding European Patent Application No. 19192005.7.

*Primary Examiner* — Jonathan M Blancha
(74) *Attorney, Agent, or Firm* — F. Chau & Associates, LLC

(57) ABSTRACT

A liquid crystal display device includes a liquid crystal display panel, a light source configured to provide the liquid crystal display panel with a light, a vertical blank detector circuit configured to calculate a counting value of a vertical blank period of a frame by counting a synchronization signal, a luminance correction value calculator circuit configured to calculate a luminance correction value by comparing the counting value of the vertical blank period with a plurality of reference counting values, and a light source driver configured to generate a light source driving signal and provide the light source driving signal to the light source. The light source driving signal has a normal level corresponding to a normal luminance value in an active period of the frame and has a correction level corresponding to the luminance correction value in the vertical blank period of the frame.

20 Claims, 20 Drawing Sheets

(52) U.S. Cl.
CPC ..... *G09G 2320/064* (2013.01); *G09G 2320/0646* (2013.01)

(58) Field of Classification Search
USPC ..... 345/691
See application file for complete search history.

(56) References Cited

U.S. PATENT DOCUMENTS

| | | | | |
|---|---|---|---|---|
| 2012/0327072 | A1* | 12/2012 | Jeon | H04N 13/341 345/419 |
| 2014/0267448 | A1 | 9/2014 | Albrecht et al. | |
| 2015/0371609 | A1 | 12/2015 | Choi et al. | |
| 2016/0117995 | A1* | 4/2016 | Lee | G09G 3/20 345/691 |
| 2016/0225327 | A1 | 8/2016 | Jang et al. | |
| 2016/0284281 | A1 | 9/2016 | Suyama et al. | |
| 2016/0379584 | A1* | 12/2016 | Onishi | G09G 3/2025 345/691 |
| 2017/0124958 | A1 | 5/2017 | Pyo et al. | |
| 2017/0256210 | A1* | 9/2017 | Kato | G02F 1/137 |

* cited by examiner

FIG. 3D

| GRAY | Left | Right | Center | Up | Down |
|---|---|---|---|---|---|
| 32 | -0.27nit | -0.32nit | -0.12nit | 0.10nit | -0.10nit |
| 64 | -0.55nit | 0.38nit | 0.63nit | 0.84nit | 0.66nit |
| 128 | 0.87nit | 0.40nit | 1.20nit | -1.07nit | 2.22nit |
| 192 | 4.35nit | 3.74nit | 3.84nit | 4.97nit | 5.05nit |
| 256 | 3.97nit | 3.08nit | 2.96nit | 3.87nit | 3.46nit |

LUMINANCE DIFFERENCE BY LOCATION/GRAY (100HZ - 50HZ)

231

| COUNT VALUE(CV) | B1 | B2 | ··· | B8 | ··· | BN |
|---|---|---|---|---|---|---|
| CV≥CV1 | a1 | a2 | ··· | a8 | ··· | aN |
| CV≥CV2 | b1 | b2 | ··· | b8 | ··· | bN |
| CV≥CV3 | c1 | c2 | ··· | c8 | ··· | cN |
| CV≥CV4 | d1 | d2 | ··· | d8 | ··· | dN |
| CV≥CV5 | e1 | e2 | ··· | e8 | ··· | eN |
| CV≥CV6 | f1 | f2 | ··· | f8 | ··· | fN |

FIG. 10

234

| COUNT VALUE(CV) | GRAYSCALE | B1 | B2 | ··· | BN |
|---|---|---|---|---|---|
| CV≥CV1 | 32 | a11 | a12 | ··· | a1N |
| | 64 | a21 | a22 | | a2N |
| | 128 | a31 | a32 | | a3N |
| | 192 | a41 | a42 | | a4N |
| CV≥CV2 | 32 | b11 | b12 | ··· | b1N |
| | 64 | b21 | b22 | | b2N |
| | 128 | b31 | b32 | | b3N |
| | 192 | b41 | b42 | | b4N |
| CV≥CV3 | 32 | c11 | c12 | ··· | c1N |
| | 64 | c21 | c22 | | c2N |
| | 128 | c31 | c32 | | c3N |
| | 192 | c41 | c42 | | c4N |
| CV≥CV4 | 32 | d11 | d12 | ··· | d1N |
| | 64 | d21 | d22 | | d2N |
| | 128 | d31 | d32 | | d3N |
| | 192 | d41 | d42 | | d4N |
| ⋮ | | | | | |

LIQUID CRYSTAL DISPLAY DEVICE AND METHOD OF DRIVING THE SAME

CROSS-REFERENCE TO RELATED APPLICATIONS

This application claims priority under 35 U.S.C. § 119 to Korean Patent Application No. 10-2018-0098219 filed on Aug. 22, 2018, the disclosure of which is incorporated by reference herein in its entirety.

TECHNICAL FIELD

Exemplary embodiments of the inventive concept relate to a liquid crystal display device and a method of driving the liquid crystal display device. More particularly, exemplary embodiments of the inventive concept relate to a liquid crystal display device capable of improving display quality and a method of driving the liquid crystal display device.

DISCUSSION OF THE RELATED ART

A liquid crystal display (LCD) device typically includes a liquid crystal panel for displaying an image using light transmittance of a liquid crystal layer, a driving circuit for driving the liquid crystal panel, and a backlight unit for providing light to the liquid crystal panel.

An external graphics processing unit (GPU) changes the image frame rate of an image frame constituting image data in real time. A scaler adjusts the image frame rate to a panel frame rate of a panel driving frame for displaying an image on the liquid crystal display panel, and provides the image frame rate to the liquid crystal display device.

When the image frame rate is slower or faster than the panel frame rate, the image of a current frame is outputted to the liquid crystal display device, or the image of a next frame is outputted while the image of the current frame is being output. As a result, a phenomenon known as screen tearing may occur.

To eliminate or reduce the effects of screen tearing, the scaler may operate in a vertical synchronization mode. In the vertical synchronization mode, when the frame rate is slow, the scaler repeatedly outputs the image of the previous frame to the liquid crystal display device. As a result, a picture displayed on the liquid crystal display device may be delayed, causing a phenomenon known as screen stuttering.

To eliminate or reduce the effects caused by the image frame rate varying, an adaptive synchronization technique has been proposed in which the vertical blank interval in the panel driving frame is increased or decreased to match the image frame rate. Since the vertical blank interval in the panel driving frame is different, the average luminance of the liquid crystal display panel is changed for each frame. As a result, a defective display effect known as flickering may be visually recognized.

SUMMARY

Exemplary embodiments of the inventive concept provide a liquid crystal display device capable of improving a luminance deviation according to a variation of the vertical blank period.

Exemplary embodiments of the inventive concept provide a method of driving the liquid crystal display device.

According to an exemplary embodiment of the inventive concept, a liquid crystal display device includes a liquid crystal display panel, a light source configured to provide the liquid crystal display panel with a light, a vertical blank detector circuit configured to calculate a counting value of a vertical blank period of a frame by counting a synchronization signal, a luminance correction value calculator circuit configured to calculate a luminance correction value by comparing the counting value of the vertical blank period with a plurality of reference counting values, and a light source driver configured to generate a light source driving signal and provide the light source driving signal to the light source. The light source driving signal has a normal level corresponding to a normal luminance value in an active period of the frame and has a correction level corresponding to the luminance correction value in the vertical blank period of the frame.

In an exemplary embodiment, the luminance correction value calculator circuit is configured to sequentially compare the counting value of the vertical blank period with the plurality of reference counting values, and sequentially calculate the luminance correction value when the counting value of the vertical blank period is equal to or greater than one of the reference counting values.

In an exemplary embodiment, the luminance correction value calculator circuit is configured to maintain the normal luminance value corresponding to the active period of the frame when the counting value of the vertical blank period is smaller than a smallest reference counting value of the vertical blank period.

In an exemplary embodiment, the luminance correction value calculator circuit is configured to change to the normal luminance value corresponding to the active period of a next frame when a start signal corresponding to the next frame rises.

In an exemplary embodiment, the plurality of reference counting values corresponds to counting values of a plurality of different vertical blank periods.

In an exemplary embodiment, the light source includes a plurality of light-emitting blocks. The light source driver is configured to generate a plurality of light source driving signals and provide the plurality of light source driving signals to the plurality of light-emitting blocks.

In an exemplary embodiment, the luminance correction value calculator circuit is configured calculate a plurality of luminance correction values for the plurality of light-emitting blocks by comparing the counting value of the vertical blank period with the plurality of reference counting values. The plurality of light source driving signals have the normal level corresponding to the normal luminance value preset for each light-emitting block in the active period and a luminance level corresponding to one of the luminance correction values in the vertical blank period.

In an exemplary embodiment, the liquid crystal display device further includes a histogram analyzer circuit configured to analyze image data of a plurality of display blocks corresponding to the plurality of light-emitting blocks, and calculate a representative grayscale for each display block.

In an exemplary embodiment, the luminance correction value calculator circuit is configured to calculate a luminance correction value for each light-emitting block based on the representative grayscale.

In an exemplary embodiment, the liquid crystal display device further includes a mode determiner circuit configured to determine whether a current frame is displayed according to an adaptive synchronous mode or a normal synchronous mode by comparing counting values of a plurality of vertical blank periods corresponding to a plurality of frames with a reference value. The vertical blank period is variable in the adaptive synchronous mode and the vertical blank period is constant in the normal synchronous mode.

According to an exemplary embodiment of the inventive concept, a method of driving a liquid crystal display device includes calculating a counting value of a vertical blank period in a frame by counting a synchronization signal, calculating a luminance correction value by comparing the counting value of the vertical blank period with a plurality of reference counting values, and generating a light source driving signal having a normal level corresponding to a normal luminance value in an active period of the frame and having a correction level corresponding to the luminance correction value in the vertical blank period of the frame.

In an exemplary embodiment, the method further includes sequentially comparing the counting value of the vertical blank period with the plurality of reference counting values, and sequentially calculating the luminance correction value when the counting value of the vertical blank period is equal to or greater than one of the reference counting values.

In an exemplary embodiment, the method further includes maintaining the normal luminance value corresponding to the active period of the frame when the counting value of the vertical blank period is smaller than a smallest reference counting value of the vertical blank period.

In an exemplary embodiment, the method further includes changing to the normal luminance value corresponding to the active period of a next frame when a start signal corresponding to the next frame rises.

In an exemplary embodiment, the plurality of reference counting values corresponds to counting values of a plurality of different vertical blank periods.

In an exemplary embodiment, the method further includes generating a plurality of light source driving signals, and providing the plurality of light source driving signals to a plurality of light-emitting blocks.

In an exemplary embodiment, the method further includes calculating a plurality of luminance correction values for the plurality of light-emitting blocks by comparing the counting value of the vertical blank period with the plurality of reference counting values. The plurality of light source driving signals have the normal level corresponding to the normal luminance value preset for each light-emitting block in the active period and a luminance level corresponding to one of the luminance correction values in the vertical blank period.

In an exemplary embodiment, the method further includes analyzing image data of a plurality of display blocks corresponding to the plurality of light-emitting blocks, and calculating a representative grayscale for each display block.

In an exemplary embodiment, the method further includes calculating a luminance correction value for each light-emitting block based on the representative grayscale.

In an exemplary embodiment, the method further includes determining whether a current frame is displayed according to an adaptive synchronous mode or a normal synchronous mode by comparing counting values of a plurality of vertical blank periods corresponding to a plurality of frames with a reference value. The vertical blank period is variable in the adaptive synchronous mode and the vertical blank period is constant in the normal synchronous.

According to exemplary embodiments of the inventive concept, by correcting the luminance level of the light according to the variation of the vertical blank interval, the luminance difference of the image due to the variation of the vertical blank interval may be eliminated or reduced. Further, the luminance level of the light may be corrected based on the grayscale of the image.

BRIEF DESCRIPTION OF THE DRAWINGS

The above and other features of the inventive concept will become more apparent by describing in detail exemplary embodiments thereof with reference to the accompanying drawings, in which:

FIGS. 3A to 3D are diagrams illustrating a luminance difference of an image displayed on a liquid crystal display device.

FIG. 10 is a conceptual diagram illustrating a second lookup table according to an exemplary embodiment.

DETAILED DESCRIPTION OF THE EXEMPLARY EMBODIMENTS

Figure 1:
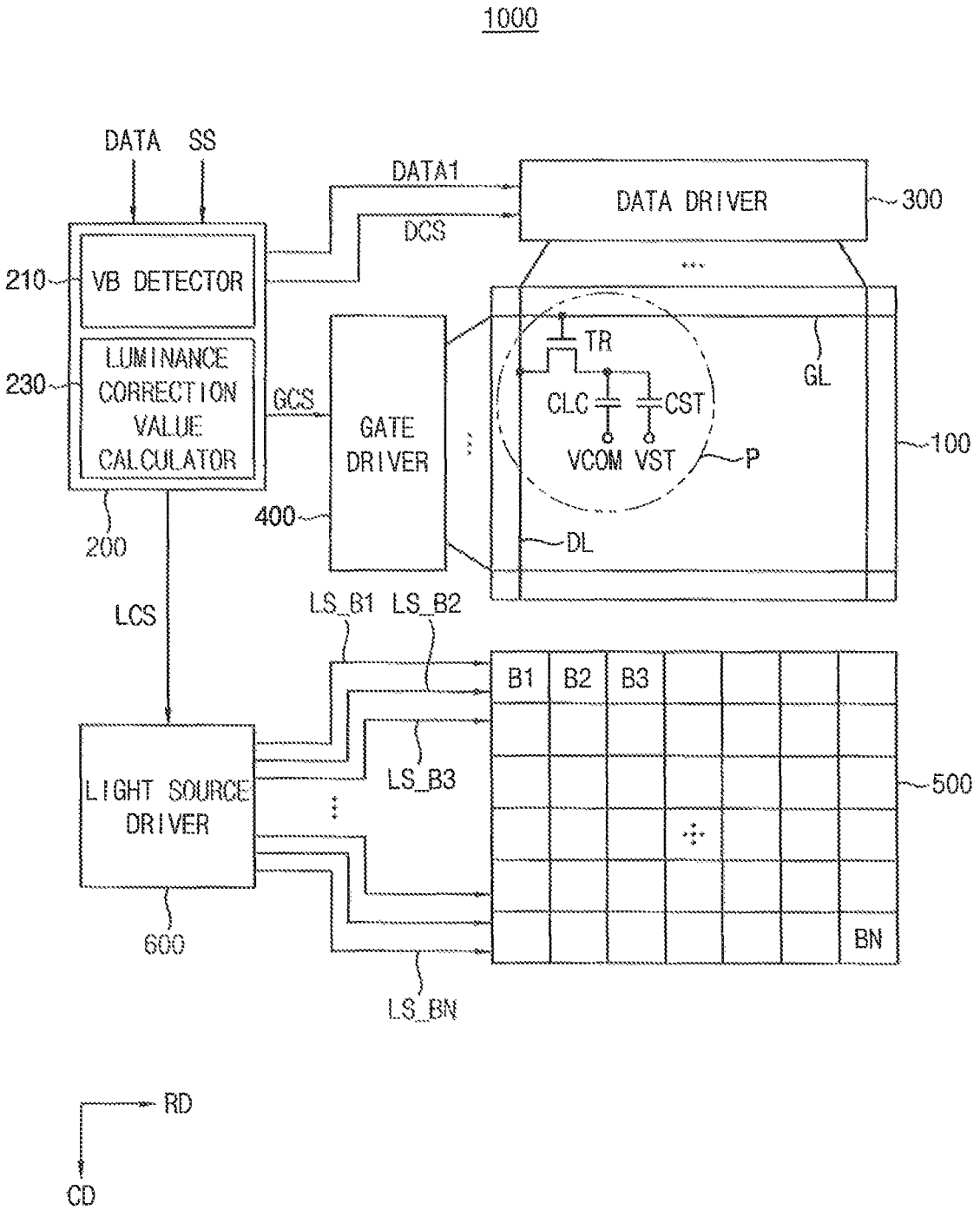
FIG. 1 is a block diagram illustrating a liquid crystal display device according to an exemplary embodiment.

Exemplary embodiments of the inventive concept will be described more fully hereinafter with reference to the accompanying drawings. Like reference numerals may refer to like elements throughout the accompanying drawings.

It will be understood that the terms "first," "second," "third," etc. are used herein to distinguish one element from another, and the elements are not limited by these terms. Thus, a "first" element in an exemplary embodiment may be described as a "second" element in another exemplary embodiment.

It should be understood that descriptions of features or aspects within each exemplary embodiment should typically be considered as available for other similar features or aspects in other exemplary embodiments, unless the context clearly indicates otherwise.

Figure 2:
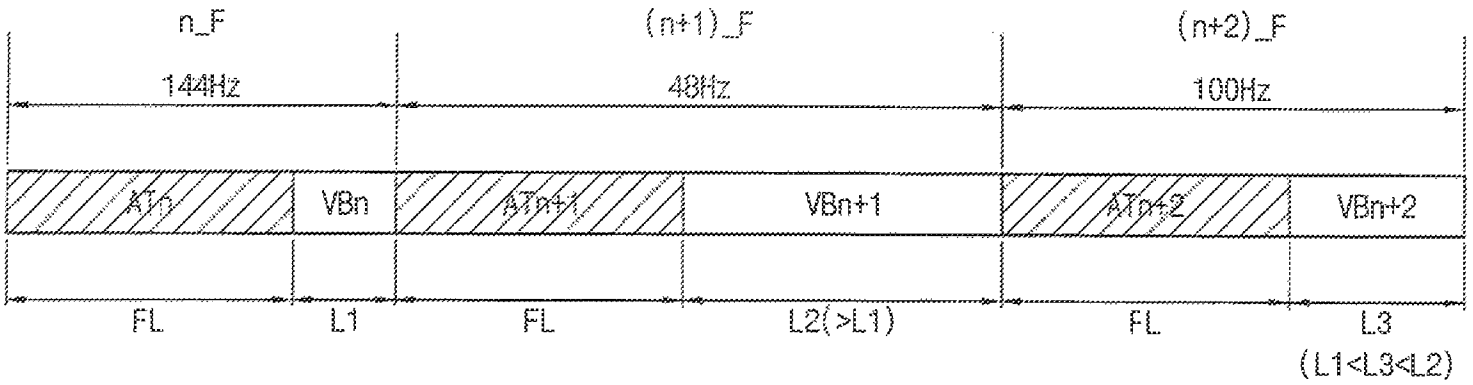
FIG. 2 is a conceptual diagram illustrating a frame displayed according to an adaptive synchronous mode according to an exemplary embodiment.

FIG. 1 is a block diagram illustrating a liquid crystal display device according to an exemplary embodiment. FIG. 2 is a conceptual diagram illustrating a frame displayed according to an adaptive synchronous mode according to an exemplary embodiment.

Referring to FIG. 1, the liquid crystal display device 1000 may include a liquid crystal panel 100, a timing controller 200, a data driver 300, a gate driver 400, a light source 500 and a light source driver 600. The data driver 300, gate driver 400 and light source driver 600 may also be referred to herein as a data driver circuit, a gate driver circuit and a light source driver circuit, respectively.

The liquid crystal panel 100 may include a plurality of data lines DL, a plurality of gate lines GL and a plurality of pixels P.

The plurality of data lines DL extends in a column direction CD and is arranged in a row direction RD intersecting the column direction CD. The plurality of gate lines GL extends in the row direction RD and is arranged in the column direction CD.

The plurality of pixels P may be arranged in a matrix form including a plurality of pixel rows and a plurality of pixel columns. Each pixel P includes a transistor TR connected to a data line DL and a gate line GL, a liquid crystal capacitor CLC connected to the transistor TR, and a storage capacitor CST connected to the liquid crystal capacitor CLC. A liquid crystal common voltage VCOM is applied to the liquid crystal capacitor CLC, and a storage common voltage VST is applied to the storage capacitor CST. The liquid crystal common voltage VCOM and the storage common voltage VST may be the same voltage.

The timing controller 200 receives image data DATA and a synchronization signal SS from a graphics processing unit GPU, which is an external device. The synchronization signal SS may include a data enable signal.

Referring to FIG. 2, the timing controller 200 receives a plurality of frames whose frame frequency varies.

An n-th frame n_F has a frame frequency of 144 Hz, an (n+1)-th frame (n+1)_F has a frame frequency of 48 Hz, and an (n+2)-th frame (n+2)_F has a frame frequency of 100 Hz.

The n-th frame n_F of 144 Hz has an n-th active period ATn of a fixed length FL and an n-th vertical blank period VBn of a first length L1. The (n+1)-th frame (n+1)_F of 48 Hz has an (n+1)-th active period ATn+1 of the fixed length FL and an (n+1)-th vertical blank period VBn+1 having a second length L2 longer than the first length L1. The (n+2)-th frame (n+2)_F of 100 Hz has an (n+2)-th active period ATn+2 of the fixed length FL and an (n+2)-th vertical blank period VBn+2 having a third length L3 that is longer than the first length L1 and shorter than the second length L2.

Referring again to FIG. 1, the timing controller 200 generates a plurality of control signals based on the synchronization signal SS. The plurality of control signals may include a data control signal DCS that controls the data driver 300, a gate control signal GCS that controls the gate driver 400, and a light source control signal LCS that controls the light source driver 600. The image data DATA are corrected through various correction algorithms and corrected image data DATA1 are provided to the data driver 300.

The data driver 300 converts the corrected image data DATA1 into an analog data voltage for each horizontal period based on the data control signal DCS, and outputs the image data to the data lines DL.

The gate driver 400 generates a plurality of gate signals based on the gate control signal GCS, and sequentially outputs the plurality of gate signals to a plurality of gate lines GL.

For example, the liquid crystal panel 100 charges the liquid crystal panel 100 with n-th frame image data during the n-th active period ATn of the n-th frame n_F in the liquid crystal panel 100, and maintains n-th frame image data charged in the liquid crystal panel 100 during the n-th vertical blank period VBn of the first length L1.

The liquid crystal panel 100 charges the liquid crystal panel 100 with (n+1)-th frame image data during the (n+1)-th active period ATn+1 of the (n+1)-th frame (n+1)_F in the liquid crystal panel 100, and maintains (n+1)-th frame image data charged in the liquid crystal panel 100 during the (n+1)-th vertical blank period VBn+1 of the second length L2.

The liquid crystal panel 100 charges the liquid crystal panel 100 with (n+2)-th frame image data during the (n+2)-th active period ATn+2 of the (n+2)-th frame (n+2)_F in the liquid crystal panel 100, and maintains (n+2)-th frame image data charged in the liquid crystal panel 100 during the (n+2)-th vertical blank period VBn+2 of the third length L3.

As the vertical blank period of the frame is longer, the charged data voltage in the liquid crystal panel 100 decreases due to a leakage current, so that an average luminance of the image displayed on the liquid crystal panel 100 decreases.

Therefore, the average luminance of the image displayed on the liquid crystal panel 100 increases for the n-th frame n_F in which the vertical blank period is the shortest, and decreases for the (n+1)-th frame (n+1)_F in which the vertical blank period is the longest.

According to an exemplary embodiment, the luminance difference due to the change of the vertical blank period may be removed by correcting the luminance of the light generated from the light source 500 according to the length of the vertical blank period.

According to an exemplary embodiment, the timing controller 200 may further include a vertical blank (VB) detector 210 and a luminance correction value calculator 230 which corrects the luminance of the light according to the length of the vertical blank period of the frame. The VB detector 210 and the luminance correction value calculator 230 may also be referred to herein as a VB detector circuit and a luminance correction value calculator circuit, respectively.

The VB detector 210 counts the synchronization signal SS to calculate the counting value of the vertical blank period of the frame. For example, the VB detector 210 may count the data enable signal to calculate the counting value of the vertical blank period. Alternatively, the VB detector 210 may count a clock signal, which is an internal synchronization signal generated from an oscillator included in the timing controller 200, to calculate a counting value of the vertical blank period.

The luminance correction value calculator 230 calculates a correction value for correcting the luminance of the light according to the counting value of the vertical blank period provided in the VB detector 210. The luminance correction value calculator 230 may provide the correction value to the light source driver 600, which provides a driving signal to the light source 500.

The light source 500 is disposed on the back of the liquid crystal panel 100 and provides light to the liquid crystal panel 100. The light source 500 provides the liquid crystal panel 100 with a luminance-controlled light based on a light source driving signal provided from the light source driver 600.

The light source 500 includes a plurality of light-emitting blocks B1, B2, . . . , BN. Each light-emitting block may include at least one light emitting diode. The plurality of light-emitting blocks B1, B2, . . . , BN may provide light to respectively corresponding display blocks of the liquid crystal panel 100.

The light source driver 600 generates a light source driving signal that drives the light source 500 based on the light source control signal LCS.

According to an exemplary embodiment, the light source driver 600 generates a plurality of light source driving signals LS_B1, LS_B2, LS_B3, . . . , LS_BN for driving the plurality of light-emitting blocks B1, B2, . . . , BN. The plurality of light source driving signals LS_B1, LS_B2, LS_B3, . . . , LS_BN may be, for example, a digital pulse width modulation (PWM) signal or an analog dimming signal.

According to an exemplary embodiment, the light source driver 600 generates the plurality of light source driving signals LS_B1, LS_B2, LS_B3, . . . , LS_BN based on a plurality of correction values of the plurality of light-emitting blocks B1, B2, . . . , BN calculated according to the counting value of the vertical blank period provided from the luminance correction value calculator 230.

Each of the plurality of light source driving signals LS_B1, LS_B2, LS_B3, . . . , LS_BN may have a normal luminance level preset corresponding to each light-emitting block in an active period, and have a correction level corresponding to a correction value calculated according to a counting value of a vertical blank period in a vertical blank period. The correction value may be a plurality, and the light source driving signal may have a plurality of correction levels in the vertical blank period.

According to an exemplary embodiment, the luminance difference of the image due to the change of the vertical blank period may be removed by correcting the luminance of the light generated from each of the plurality of light-emitting blocks according to the counting value of the vertical blank period. In addition, the luminance difference of the image may be corrected for each position by individually correcting the light of the plurality of light-emitting blocks.

Figure 3A:
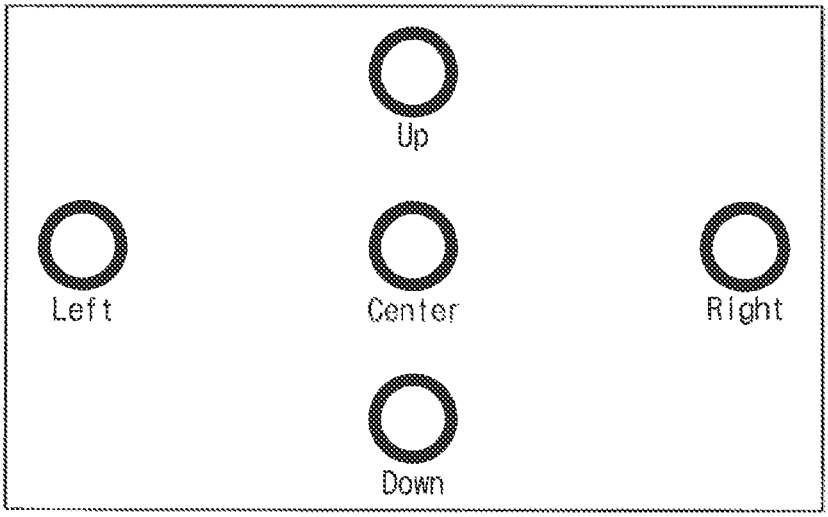
Figure 3B:
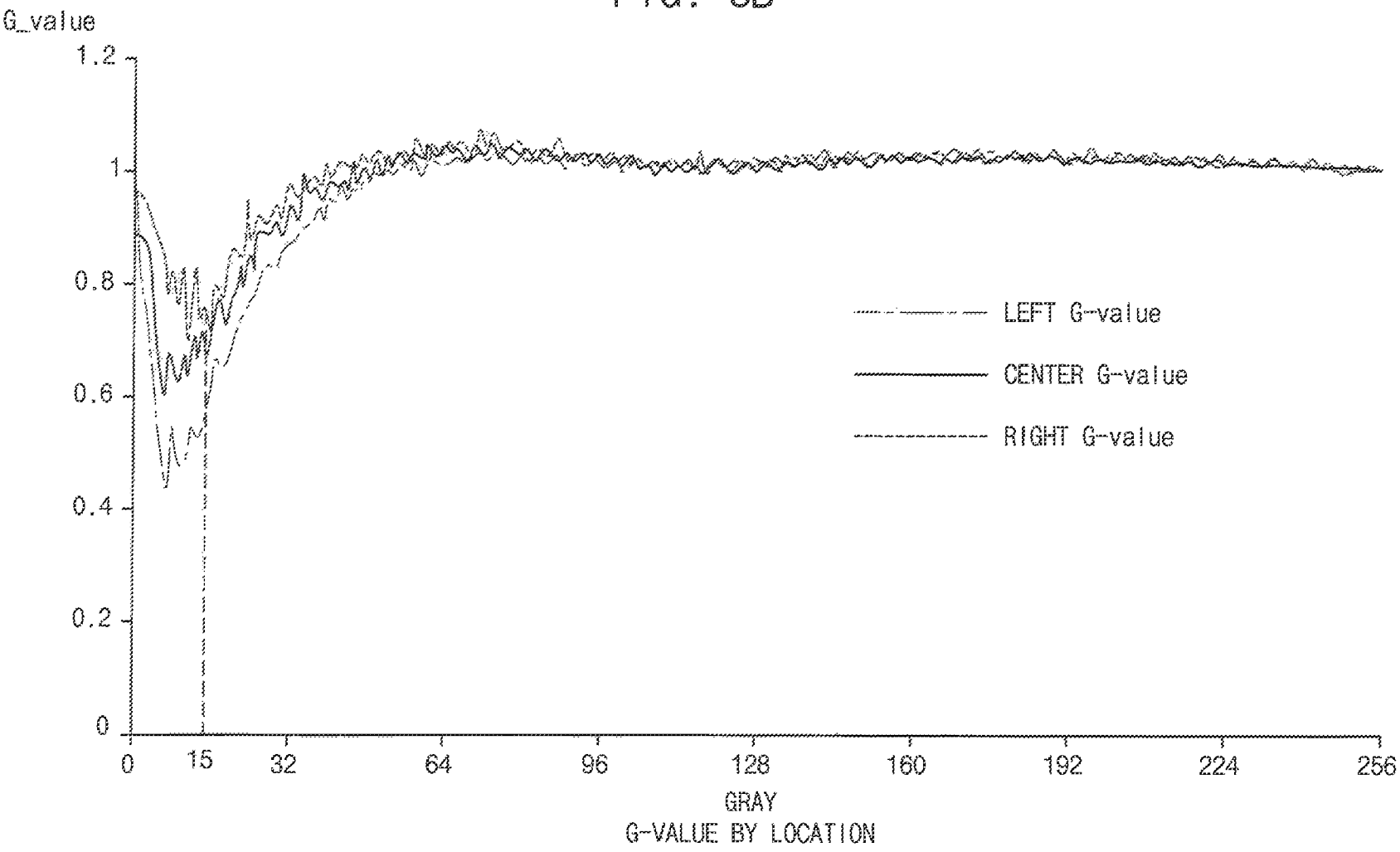
Figure 3C:
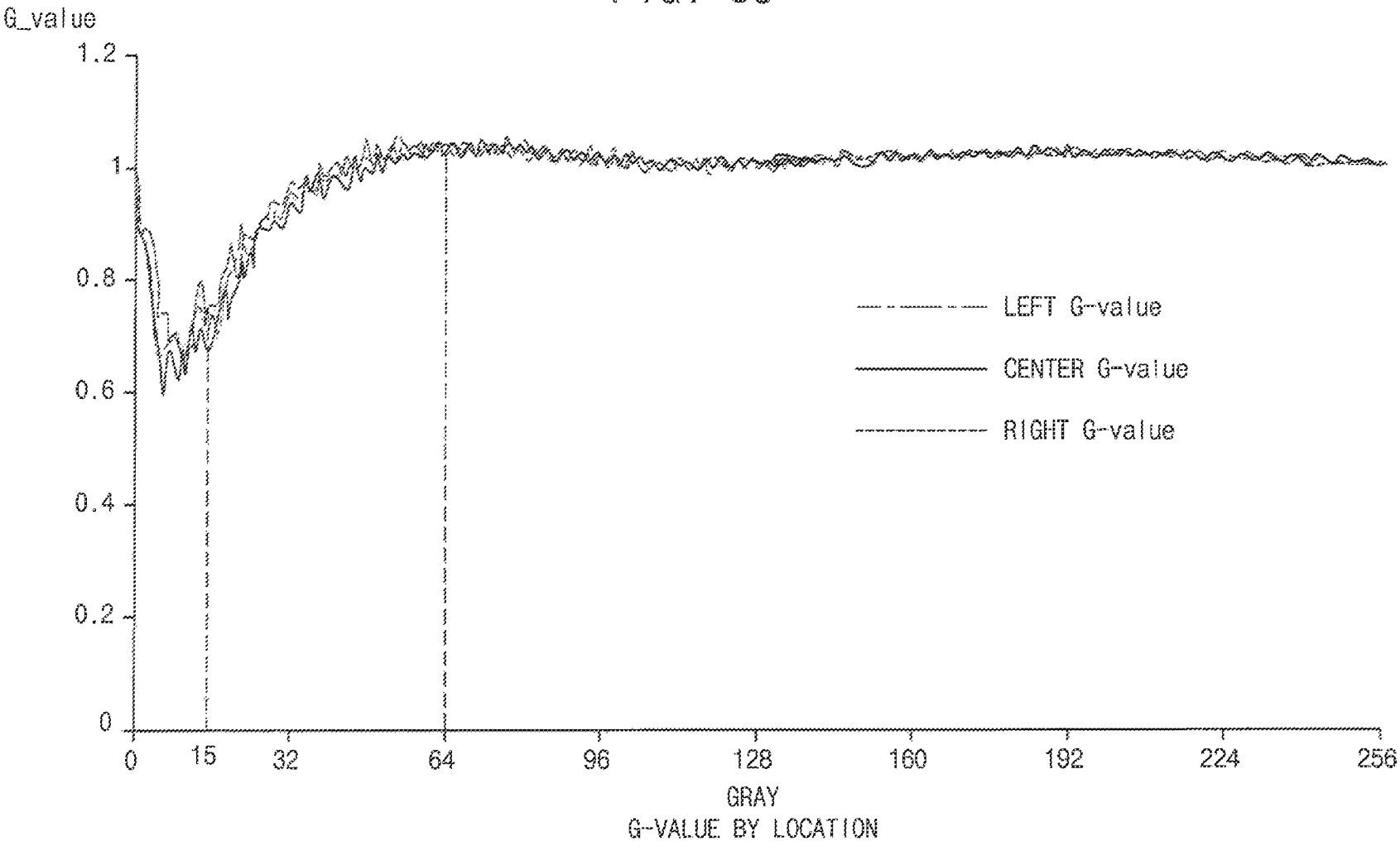

FIGS. 3A to 3C are diagrams illustrating a luminance difference of an image displayed on a liquid crystal display device.

FIG. 3A is a plan view illustrating a liquid crystal display device according to a comparative exemplary embodiment.

According to the comparative exemplary embodiment, the liquid crystal display device displays each of grayscale images of 32-grayscale, 64-grayscale, 128-grayscale, 192-grayscale and 256-grayscale with a frame frequency of 100 Hz. An inspection device measures luminance at sample locations on a liquid crystal panel displaying a grayscale image displayed. For example, the sample locations include a central area Center, a left area Left, a right area Right, an upper area Up and a lower area Down.

In addition, the liquid crystal display device displays each of grayscale images of 32-grayscale, 64-grayscale, 128-grayscale, 192-grayscale and 256-grayscale with a frame frequency of 50 Hz. The inspection device measures luminance at the central area Center, the left area Left, the right area Right, the upper area Up and the lower area Down on the liquid crystal panel displaying a grayscale image displayed.

FIG. 3B is a graph diagram illustrating a G-Value with respect to a vertical direction of the liquid crystal panel. FIG. 3C is a graph diagram illustrating a G-Value with respect to a horizontal direction of the liquid crystal panel.

The G-Value shown in FIGS. 3B and 3C may be defined by the following equation:

$$\text{G-Value} = \text{a first luminance value} / \text{a second luminance value} \qquad \text{Equation 1}$$

In Equation 1, the first luminance value is a luminance value when driving with the frequency of 100 Hz, and the second luminance value is a luminance value when driving with the frequency of 50 Hz.

Referring to the G-Values of the upper area Up, the central area Center and the lower area Down with respect to the vertical direction as shown in FIG. 3B, in a lower grayscale range such as 0-grayscale to 64-grayscale, the G-Values of the upper area Up, the central area Center and the lower area Down are all smaller than 1. In the lower grayscale range, the luminance value when driving with the frame frequency of 50 Hz may be higher than the luminance value when driving with the frame frequency of 100 Hz.

In addition, in 15-grayscale, the G-Value of the lower area Down is smaller than the G-Value of the central area Center and larger than the G-Value of the upper area Up. The lower area Down in the liquid crystal panel has a relatively large luminance difference according to the frame frequency. The upper area Up in the liquid crystal panel has a relatively small luminance difference according to the frame frequency.

Referring to the G-Values of the upper area Up, the left area Left, the central area Center and the right area Right with respect to the horizontal direction as shown in FIG. 3C, in a lower grayscale range such as 0-grayscale to 64-grayscale, the G-Values of the upper area Up, the central area Center and the lower area Down are all smaller than 1. In the lower grayscale range, the luminance value when driving with the frame frequency of 50 Hz may be higher than the luminance value when driving with the frame frequency of 100 Hz.

In the lower grayscale range, the G-Values of the left area Left and the central area Center are generally similar and the G-Value of the right area Right is relatively large. The left area Left and the central area Center in the liquid crystal panel have similar luminance differences according to the frame frequency. The right area Right in the liquid crystal panel has a relatively large luminance difference according to the frame frequency.

According to FIGS. 3B and 3C, the luminance difference according to the change of the frame frequency is different according to the position in the liquid crystal panel.

FIG. 3D is a diagram illustrating luminance differences with respect to grayscales and positions when driving with the frequencies of 100 Hz and 50 Hz of the frame frequency. A luminance value (nit) shown in FIG. 3D is a difference value between a luminance value when driving with the frequency of 100 Hz and a luminance value when driving with the frequency of 50 Hz.

Referring to a 32-grayscale shown in FIG. 3D, when sample grayscale is 32-grayscale, a luminance value of the left area Left is −0.27 nit, a luminance value of the right area Right is −0.32 nit, a luminance value of the central area Center is −0.12 nit, a luminance value of the upper area Up is 0.10 nit and a luminance value of the lower area Down is −0.10 nit.

The luminance values of the 32-grayscale of the left area Left, the upper area Up, the central area Center and the lower area Down when driving with the frequency of 50 Hz are higher than the luminance values of the 32-grayscale of the left area Left, the upper area Up, the central area Center and the lower area Down when driving with the frequency of 100 Hz. The luminance value of the right area Right is relatively highest. However, in the upper area Up, the luminance value of 32-grayscale when driving with the frequency of 100 Hz is higher than the luminance value of 32-grayscale when driving with 50 Hz.

According to FIG. 3D, the luminance difference according to the change of the frame frequency is different according to the position in the liquid crystal panel.

According to an exemplary embodiment, the luminance difference due to the variation of the vertical blank period is corrected for each position of the liquid crystal panel, thereby improving the display quality of the image.

Figures 4, 5:
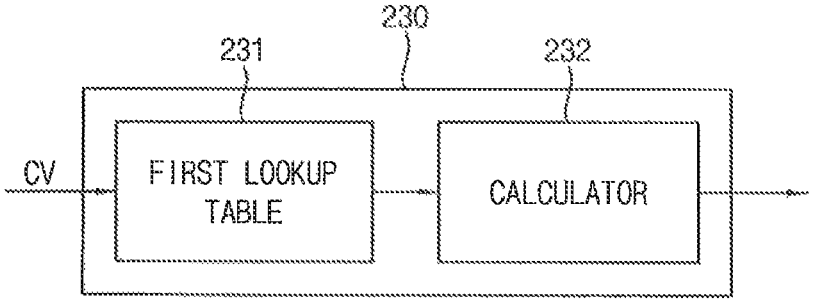
FIG. 4 is a block diagram illustrating a luminance correction value calculator according to an exemplary embodiment.
FIG. 5 is a conceptual diagram illustrating a first lookup table according to an exemplary embodiment.

FIG. 4 is a block diagram illustrating a luminance correction value calculator according to an exemplary embodiment. FIG. 5 is a conceptual diagram illustrating a first lookup table according to an exemplary embodiment.

Referring to FIG. 4, the luminance correction value calculator 230 calculates a plurality of correction values of a plurality of light-emitting blocks for correcting the luminance difference due to the variable of the vertical blank period for each position of the liquid crystal panel.

The luminance correction value calculator 230 may include a first lookup table 231 and a calculator 232.

The first lookup table 231 may store correction values of light-emitting blocks sampled according to a counting value CV counting a data enable signal or a clock signal of a vertical blank period.

As shown in FIG. 5, when the counting value CV of the vertical blank period is equal to or greater than a first reference counting value CV1, a plurality of correction values of a plurality of light-emitting blocks B1, B2, . . . , B8, . . . , BN is determined as (a1, a2, . . . , a8, . . . , and aN), respectively.

When the counting value CV of the vertical blank period is equal to or greater than a second reference counting value CV2, a plurality of correction values of a plurality of light-emitting blocks B1, B2, . . . , B8, . . . , BN is determined as (b1, b2, . . . , b8, . . . , bN), respectively. The second reference counting value CV2 may be greater than the first reference counting value CV1.

When the counting value CV of the vertical blank period is equal to or greater than a third reference counting value CV3, a plurality of correction values of a plurality of light-emitting blocks B1, B2, . . . , B8, . . . , BN is determined as (c1, c2, . . . , c8, . . . , cN), respectively. The third reference counting value CV3 may be greater than the second reference counting value CV2.

When the counting value CV of the vertical blank period is equal to or greater than a fourth reference counting value CV4, a plurality of correction values of a plurality of light-emitting blocks B1, B2, . . . , B8, . . . , BN is determined as (d1, d2, . . . , d8, . . . , dN), respectively. The fourth reference counting value CV4 may be greater than the third reference counting value CV3.

When the counting value CV of the vertical blank period is equal to or greater than a fifth reference counting value CV5, a plurality of correction values of a plurality of light-emitting blocks B1, B2, . . . , B8, . . . , BN is determined as (e1, e2, . . . , e8, . . . , eN), respectively. The fifth reference counting value CV5 may be greater than the fourth reference counting value CV4.

When the counting value CV of the vertical blank period is equal to or greater than a sixth reference counting value CV6, a plurality of correction values of a plurality of light-emitting blocks B1, B2, . . . , B8, . . . , BN is determined as (f1, f2, . . . , f8, . . . , fN), respectively. The sixth reference counting value CV6 may be greater than the fifth reference counting value CV5.

The calculator 232 calculates a plurality of correction values of a plurality of light-emitting blocks B1, B2, B3, . . . , BN according to the counting value of the vertical blank period for the frame based on the correction values stored in the first lookup table 231 in real time.

The plurality of correction values corresponding to the plurality of light-emitting blocks B1, B2, B3, . . . , BN are provided to the light source driver 600 shown in FIG. 1. The light source driver 600 generates a plurality of light source driving signals LS_B1, LS_B2, . . . , LS_BN for driving the plurality of light-emitting blocks B1, B2, B3, . . . , BN.

Figure 6:
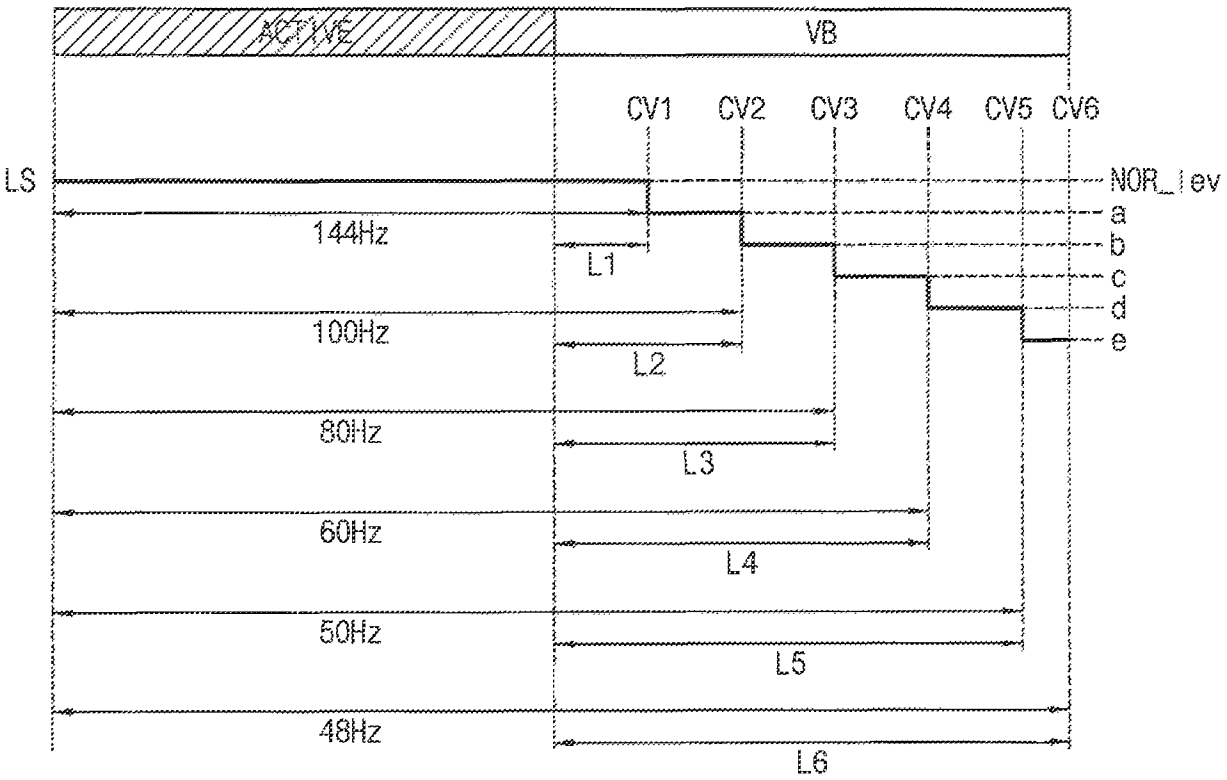
FIG. 6 is a waveform diagram illustrating a method of applying a correction value based on a counting value according to an exemplary embodiment.

FIG. 6 is a waveform diagram illustrating a method of applying a correction value based on a counting value according to an exemplary embodiment.

Referring to FIG. 6, for example, when a reference frame frequency is 144 Hz, a counting value corresponding to a first length L1 of the vertical blank period of 144 Hz may become a first reference counting value CV1. In addition, the plurality of reference counting values may be preset corresponding to vertical blank periods of the plurality of frame frequencies which have a frame rate smaller than a frame rate of 144 Hz. In FIG. 6, LS represents a light source driving signal LS.

For example, the second reference counting value CV2 may become a counting value of the vertical blank period having a second length L2 in the frame of 100 Hz. The third reference counting value CV3 may become a counting value of the vertical blank period having a third length L3 in the frame of 80 Hz. The fourth reference counting value CV4 may become a counting value of the vertical blank period having a fourth length L4 in the frame of 60 Hz. The fifth reference counting value CV5 may become a counting value of the vertical blank period having a fifth length L5 in the frame of 50 Hz. The sixth reference counting value CV6 may become a counting value of the vertical blank period having a sixth length L6 in the frame of 48 Hz.

The VB detector 210 counts the clock signal of the vertical blank period in real time and provides the counting value to the luminance correction value calculator 230.

The luminance correction value calculator determines a correction value by comparing the counting value of the real-time counted vertical blank period with the plurality of reference counting values.

When the counting value CV of the vertical blank period is smaller than the first reference counting value CV1, the luminance correction value calculator 230 applies a normal luminance value NOR_lev applied to the active period.

The luminance correction value calculator 230 calculates a first correction value when the counting value CV of the vertical blank period is equal to or greater than the first reference counting value CV1 and smaller than the second reference counting value CV2 (see a in FIG. 6). The luminance correction value calculator 230 calculates a second correction value when the counting value CV of the vertical blank period is equal to or greater than the second reference counting value CV2 and smaller than the third reference counting value CV3 (see b in FIG. 6). The luminance correction value calculator 230 calculates a third correction value when the counting value CV of the vertical blank period is equal to or greater than the third reference counting value CV3 and smaller than the fourth reference counting value CV4 (see c in FIG. 6). The luminance correction value calculator 230 calculates a fourth correction value when the counting value CV of the vertical blank period is equal to or greater than the fourth reference counting value CV4 and smaller than the fifth reference counting value CV5 (see d in FIG. 6). The luminance correction value calculator 230 calculates a fifth correction value when the counting value CV of the vertical blank period is equal to or greater than the fifth reference counting value CV5 and smaller than the sixth reference counting value CV6 (see e in FIG. 6).

FIGS. 7A to 7F are waveform diagrams illustrating a light source driving signal with a correction value applied according to the counting value of the vertical blank period.

Figure 7A:
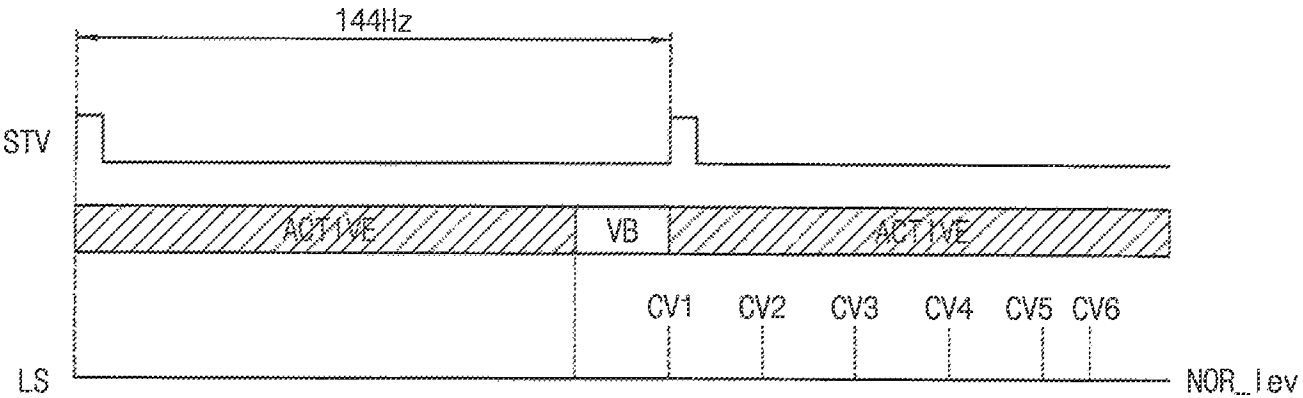
FIGS. 7A to 7F are waveform diagrams illustrating a light source driving signal with a correction value applied according to the counting value of the vertical blank period.

Referring to FIG. 7A, when a 144 Hz frame is received, the VB detector 210 counts the clock signal of the vertical blank period in the 144 Hz frame.

The luminance correction value calculator 230 applies the normal luminance value NOR_lev because the counting value CV of the vertical blank period is smaller than the first reference counting value CV1. When the counting value of the vertical blank period becomes the first reference counting value CV1, the normal luminance value NOR_lev is applied corresponding to the active period according to the start of the next frame. The start point of the next frame is as the rising point of a vertical start signal STV.

Therefore, the light source driver 600 may generate a light source driving signal LS having a normal level corresponding to the normal luminance value NOR_lev during a vertical blank period of a 144 Hz frame.

Figure 7B:
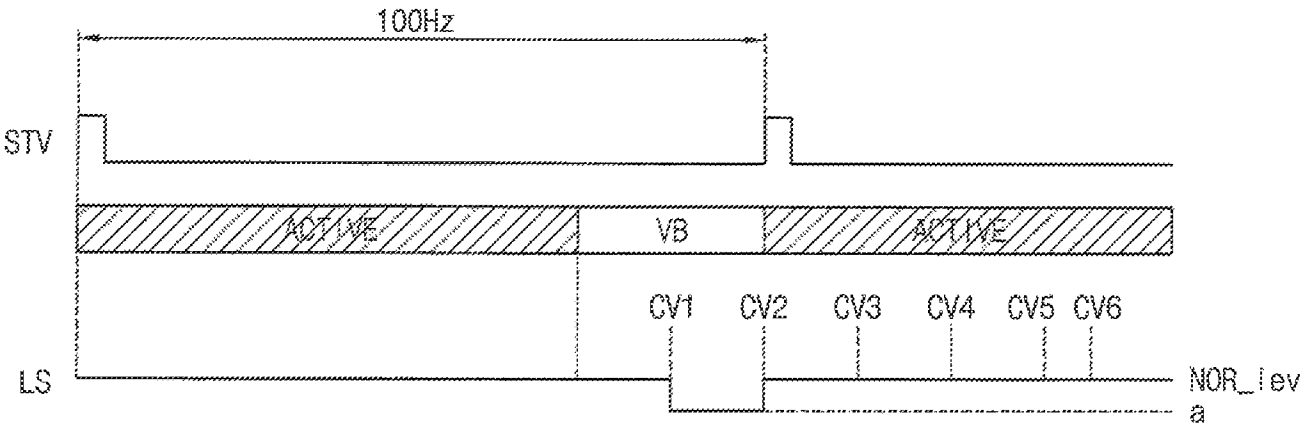

Referring to FIG. 7B, when a 100 Hz frame is received, the VB detector 210 counts the clock signal of the vertical blank period in the 100 Hz frame.

The luminance correction value calculator 230 calculates the first correction value a when the counting value of the vertical blank period is equal to or greater than the first reference counting value CV1 and is smaller than the second reference counting value CV2. When the counting value of the vertical blank period is equal to the second reference counting value CV2, a vertical start signal STV of a next frame rises. Thus, the luminance correction value calculator 230 calculates a normal luminance value NOR_lev corresponding to the active period of the next frame.

Therefore, the light source driver 600 generates a light source driving signal LS having a normal level and a first correction level respectively corresponding to the normal luminance value NOR_lev and the first correction value a during the vertical blank period of the 100 Hz frame.

Figure 7C:
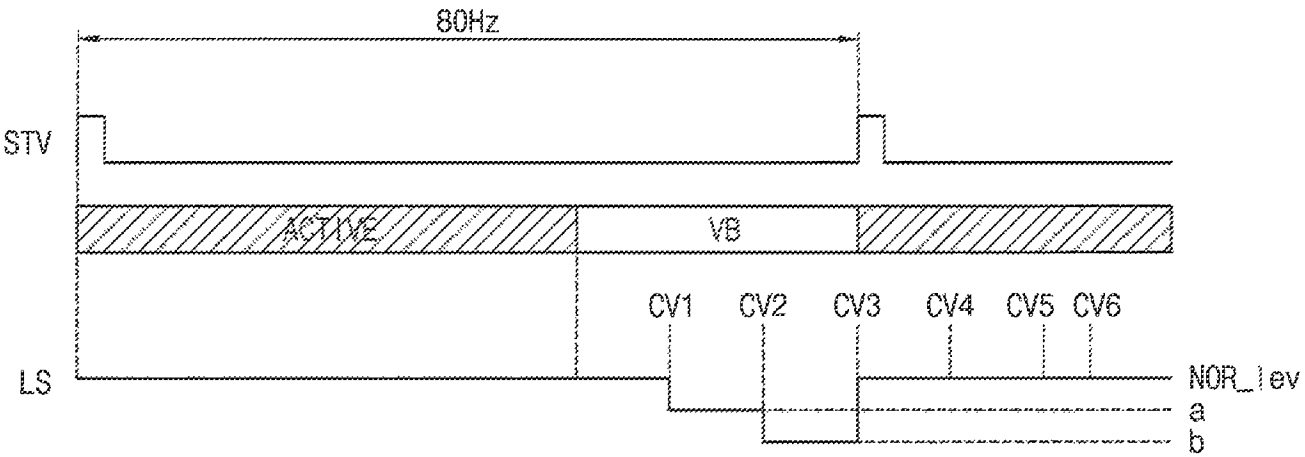

Referring to FIG. 7C, when an 80 Hz frame is received, the VB detector 210 counts the clock signal of the vertical blank period in the 80 Hz frame.

The luminance correction value calculator 230 calculates the first correction value a when the counting value of the vertical blank period is equal to or greater than the first reference counting value CV1 and is smaller than the second reference counting value CV2. The luminance correction value calculator 230 calculates the second correction value b when the counting value of the vertical blank period is equal to or greater than the second reference counting value CV2 and is smaller than the third reference counting value CV3. When the counting value of the vertical blank period is equal to the third reference counting value CV3, a vertical start signal STV of a next frame rises. Thus, the luminance correction value calculator 230 calculates the normal luminance value NOR_lev corresponding to the active period of the next frame.

Therefore, the light source driver 600 generates a light source driving signal LS having a normal level, a first correction level and a second correction level respectively corresponding to the normal luminance value NOR_lev, the first correction value a and the second correction value b during the vertical blank period of the 80 Hz frame.

Figure 7D:
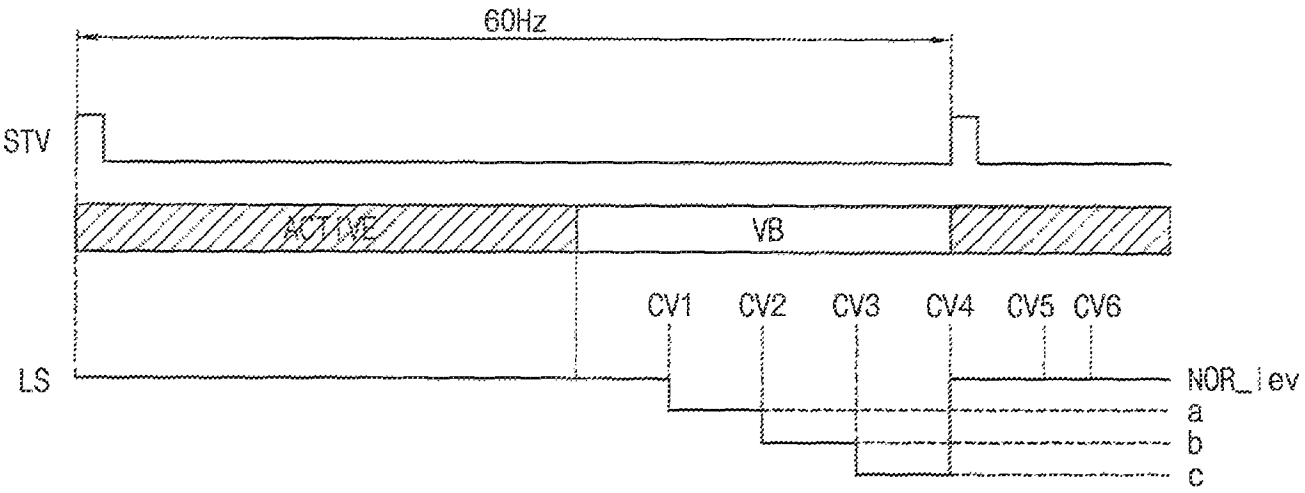

Referring to FIG. 7D, when a 60 Hz frame is received, the VB detector 210 counts the clock signal of the vertical blank period in the 60 Hz frame.

The luminance correction value calculator 230 calculates the first correction value a when the counting value of the vertical blank period is equal to or greater than the first reference counting value CV1 and is smaller than the second reference counting value CV2. The luminance correction value calculator 230 calculates the second correction value b when the counting value of the vertical blank period is equal to or greater than the second reference counting value CV2 and is smaller than the third reference counting value CV3. The luminance correction value calculator 230 calculates the third correction value c when the counting value of the vertical blank period is equal to or greater than the third reference counting value CV3 and is smaller than the fourth reference counting value CV4. When the counting value of the vertical blank period is equal to the fourth reference counting value CV4, a vertical start signal STV of a next frame rises. Thus, the luminance correction value calculator 230 calculates the normal luminance value NOR_lev corresponding to the active period of the next frame.

Therefore, the light source driver 600 generates a light source driving signal LS having a normal level, a first correction level, a second correction level and a third correction level respectively corresponding to the normal luminance value NOR_lev, the first correction value a, the second correction value b and the third correction value c during the vertical blank period of the 60 Hz frame.

Figure 7E:
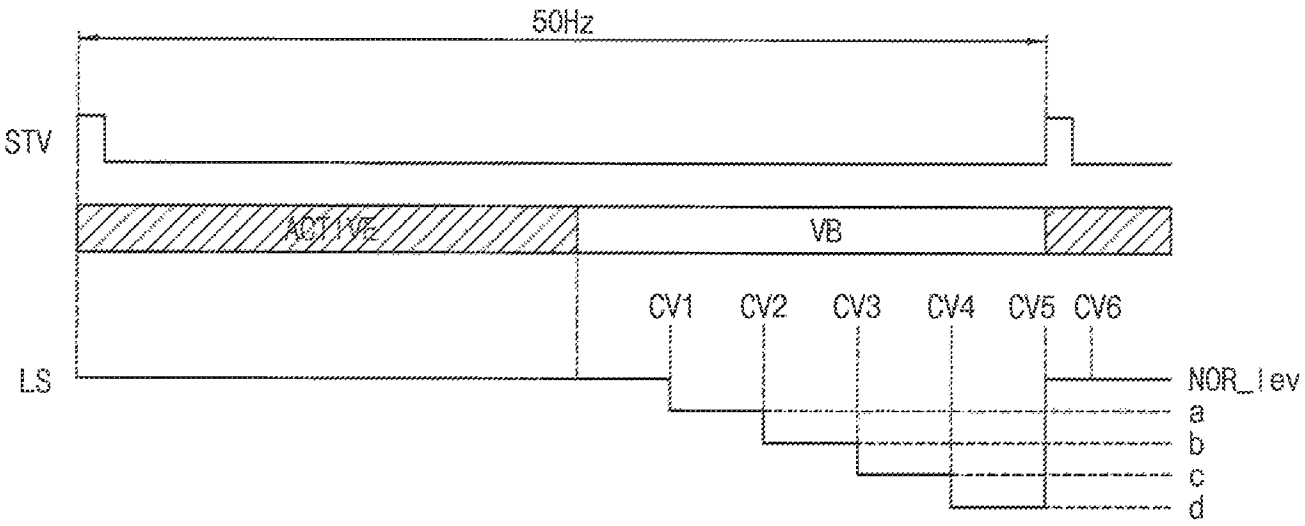

Referring to FIG. 7E, when a 50 Hz frame is received, the VB detector 210 counts the clock signal of the vertical blank period in the 50 Hz frame.

The luminance correction value calculator 230 calculates the first correction value a when the counting value of the vertical blank period is equal to or greater than the first reference counting value CV1 and is smaller than the second reference counting value CV2. The luminance correction value calculator 230 calculates the second correction value b when the counting value of the vertical blank period is equal to or greater than the second reference counting value CV2 and is smaller than the third reference counting value CV3. The luminance correction value calculator 230 calculates the third correction value c when the counting value of the vertical blank period is equal to or greater than the third reference counting value CV3 and is smaller than the fourth reference counting value CV4. The luminance correction value calculator 230 calculates the fourth correction value d when the counting value of the vertical blank period is equal to or greater than the fourth reference counting value CV4 and is smaller than the fifth reference counting value CV5. When the counting value of the vertical blank period is equal to the fifth reference counting value CV5, a vertical start signal STV of a next frame rises. Thus, the luminance correction value calculator 230 calculates the normal luminance value NOR_lev corresponding to the active period of the next frame.

Therefore, the light source driver 600 generates a light source driving signal LS having a normal level, a first correction level, a second correction level, a third correction level and a fourth correction level respectively corresponding to the normal luminance value NOR_lev, the first correction value a, the second correction value b, the third correction value c and the fourth correction value d during the vertical blank period of the 50 Hz frame.

Figure 7F:
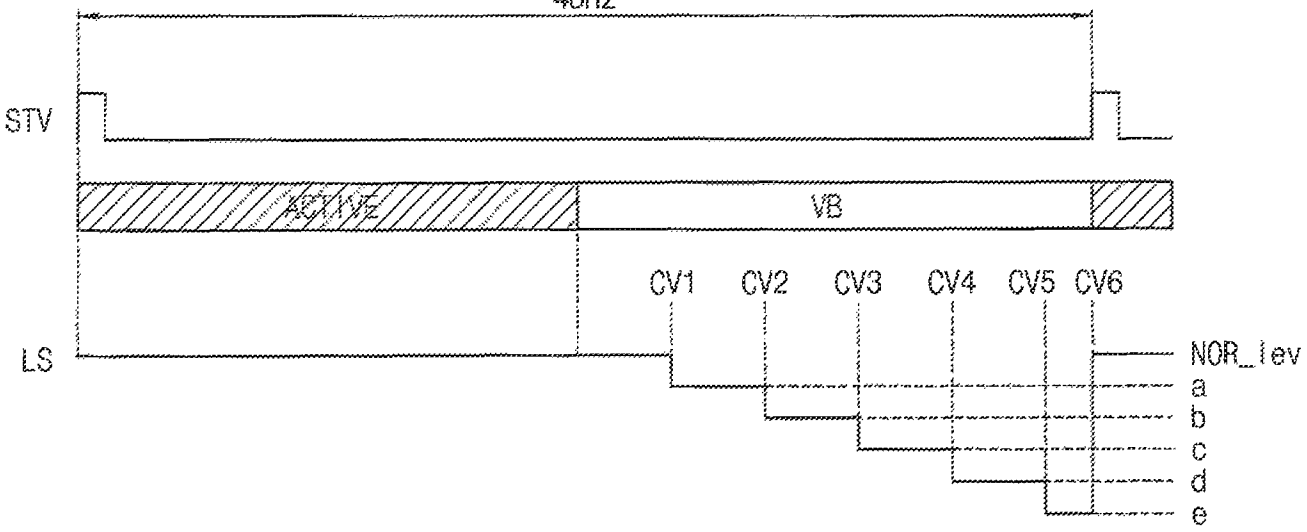

Referring to FIG. 7F, when a 48 Hz frame is received, the VB detector 210 counts the clock signal of the vertical blank period in the 48 Hz frame.

The luminance correction value calculator 230 calculates the first correction value a when the counting value of the vertical blank period is equal to or greater than the first reference counting value CV1 and is smaller than the second reference counting value CV2. The luminance correction value calculator 230 calculates the second correction value b when the counting value of the vertical blank period is equal to or greater than the second reference counting value CV2 and is smaller than the third reference counting value CV3. The luminance correction value calculator 230 calculates the third correction value c when the counting value of the vertical blank period is equal to or greater than the third reference counting value CV3 and is smaller than the fourth reference counting value CV4. The luminance correction value calculator 230 calculates the fourth correction value d when the counting value of the vertical blank period is equal to or greater than the fourth reference counting value CV4 and is smaller than the fifth reference counting value CV5. The luminance correction value calculator 230 calculates a fifth correction value e when the counting value of the vertical blank period is equal to or greater than the fifth reference counting value CV5 and is smaller than the sixth reference counting value CV6. When the counting value of the vertical blank period is equal to the sixth reference counting value CV6, a vertical start signal STV of a next frame rises. Thus, the luminance correction value calculator 230 calculates the normal luminance value NOR_lev corresponding to the active period of the next frame.

Therefore, the light source driver 600 generates a light source driving signal LS having a normal level, a first correction level, a second correction level, a third correction level, a fourth correction level and a fifth correction level respectively corresponding to the normal luminance value NOR_lev, the first correction value a, the second correction value b, the third correction value c, the fourth correction value d and the fifth correction value e during the vertical blank period of 50 Hz frame.

Figure 8:
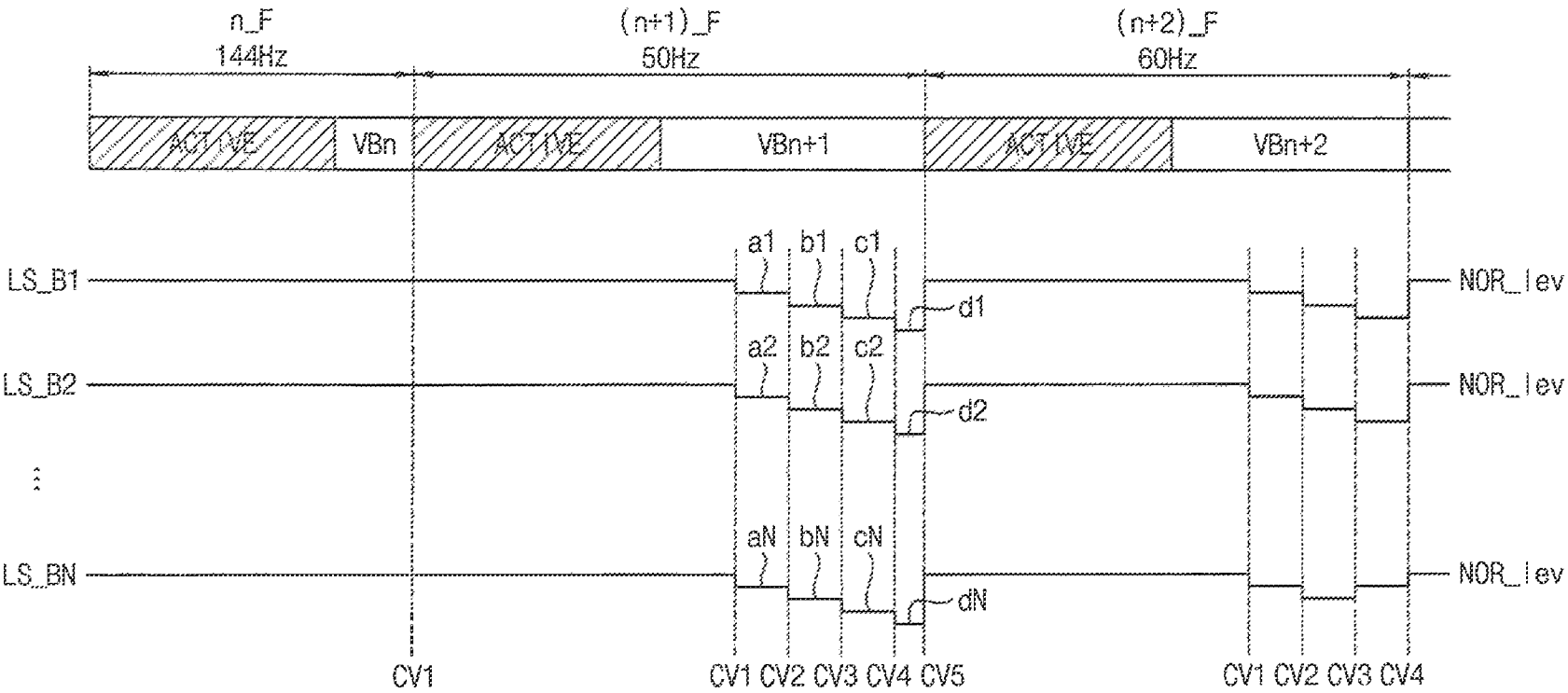
FIG. 8 is a conceptual diagram illustrating light source driving signals of light-emitting blocks according to an exemplary embodiment.

FIG. 8 is a conceptual diagram illustrating light source driving signals of light-emitting blocks according to an exemplary embodiment.

Referring to FIGS. 5 and 8, when an n-th frame n_F is received, the VB detector 210 counts a data enable signal or a clock signal of the n-th vertical blank period VBn.

The luminance correction value calculator 230 compares the counting value CV of the n-th vertical blank period VBn with the first reference counting value CV1. The counting value CV is smaller than the first reference counting value CV1 and an (n+1)-th frame (n+1)_F is started in a period in which the counting value CV is equal to the first reference counting value CV1. Thus, the luminance correction value calculator 230 calculates a normal luminance value NOR_lev during the n-th vertical blank period VBn.

The light source driver 600 generates a plurality of light source driving signals LS_B1, LS_B2, . . . , LS_BN corresponding to the n-th frame n_F.

The plurality of light source driving signals LS_B1, LS_B2, . . . , LS_BN has a normal level of the normal luminance value NOR_lev during the n-th vertical blank period VBn of the n-th frame n_F.

Then, when an (n+1)-th frame (n+1)_F is received, the VB detector 210 counts a data enable signal or a clock signal of the (n+1)-th vertical blank period VBn+1.

Referring to the first lookup table 231 shown in FIG. 5, the luminance correction value calculator 230 compares the counting value CV with the plurality of reference counting values CV1, CV2, CV3, CV4 and CV5 to calculate the first correction value a1, the second correction value b1, the third correction value c1 and the fourth correction value d1 for the first light-emitting block B1, to calculate the first correction value a2, the second correction value b2, the third correction value c2 and the fourth correction value d2 for the second light-emitting block B2, and to calculate the first correction value aN, the second correction value bN, the third correction value cN and the fourth correction value dN for the N-th light-emitting block BN.

The light source driver 600 generates a plurality of light source driving signals LS_B1, LS_B2, . . . , LS_BN corresponding to the (n+1)-th frame (n+1)_F.

For example, the first light source driving signal LS_B1 may have a normal level NOR_lev in the (n+1)-th active period, and the normal level NOR_lev, the first correction level a1, the second correction level b1, the third correction level c1 and the fourth correction level d1 in the (n+1)-th vertical blank period VBn+1. The second light source driving signal LS_B2 may have a normal level NOR_lev in the (n+1)-th active period, and the normal level NOR_lev, the first correction level a2, the second correction level b2, the third correction level c2 and the fourth correction level d2 in the (n+1)-th vertical blank period VBn+1. The N-th light source driving signal LS_BN may have a normal level NOR_lev in the (n+1)-th active period, and the normal level NOR_lev, the first correction level aN, the second correction level bN, the third correction level cN and the fourth correction level dN in the (n+1)-th vertical blank period VBn+1.

Then, when an (n+2)-th frame (n+2)_F is received, the VB detector 210 counts a data enable signal or a clock signal of the (n+2)-th vertical blank period VBn+2.

Referring to the first lookup table 231 shown in FIG. 5, the luminance correction value calculator 230 compares the counting value CV with the plurality of reference counting values CV1, CV2 and CV3 to calculate the first correction value a1, the second correction value b1 and the third correction value c1 for the first light-emitting block B1, to calculate the first correction value a2, the second correction value b2 and the third correction value c2 for the second light-emitting block B2, and to calculate the first correction value aN, the second correction value bN and the third correction value cN for the N-th light-emitting block BN.

The light source driver generates a plurality of light source driving signals LS_B1, LS_B2, . . . , LS_BN corresponding to the (n+2)-th frame (n+2)_F.

For example, the first light source driving signal LS_B1 may have a normal level NOR_lev in the (n+2)-th active period, and the normal level NOR_lev, the first correction level a1, the second correction level b1 and the third correction level c1 in the (n+2)-th vertical blank period VBn+2. The second light source driving signal LS_B2 may have a normal level NOR_lev in the (n+2)-th active period, and the normal level NOR_lev, the first correction level a2, the second correction level b2 and the third correction level c2 in the (n+2)-th vertical blank period VBn+2. The N-th light source driving signal LS_BN may have a normal level NOR_lev in the (n+2)-th active period, and the normal level NOR_lev, the first correction level aN, the second correction level bN and the third correction level cN in the (n+2)-th vertical blank period VBn+2.

According to an exemplary embodiment, the luminance of the light generated from each of the plurality of light-emitting blocks may be corrected according to the counting value of the vertical blank period. Accordingly, the luminance difference of the image due to the change of the vertical blank period may be eliminated. Also, by correcting the light of the plurality of light-emitting blocks separately, the luminance difference of the image may be corrected for each position.

Figure 9:
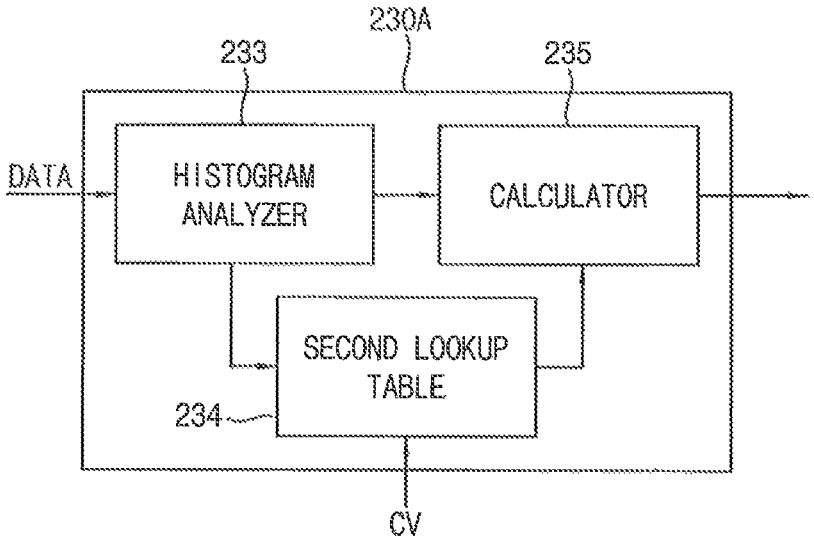
FIG. 9 is a block diagram illustrating a luminance correction value calculator according to an exemplary embodiment.

FIG. 9 is a block diagram illustrating a luminance correction value calculator according to an exemplary embodiment. FIG. 10 is a conceptual diagram illustrating a second lookup table according to an exemplary embodiment.

Referring to FIG. 9, a luminance correction value calculator 230A may include a histogram analyzer 233, a second lookup table 234 and a calculator 235. The histogram analyzer 233 and the calculator 235 may also be referred to herein as a histogram analyzer circuit and a calculator circuit, respectively.

The histogram analyzer 233 analyzes image data for each display block corresponding to each of the plurality of light-emitting blocks of the light source 500 to calculate a representative grayscale for each display block. The histogram analyzer 233 may calculate a largest grayscale among grayscales of the image data included in each display block as the representative grayscale, or calculate an average grayscale as the representative grayscale.

The second lookup table 234 may store a counting value CV counting a data enable signal or a clock signal of a vertical blank period and correction values of light-emitting blocks corresponding to sample grayscales.

For example, referring to the second lookup table 234 as shown in FIG. 10, in the condition that the count value CV of the vertical blank section is equal to or greater than the first reference counter value CV1, when sample grayscale is 32-grayscale, the correction values of the plurality of light-emitting blocks B1, B2, . . . , BN are determined as (a11, a12, . . . , a1N), when sample grayscale is 64-grayscale, the correction values of the plurality of light-emitting blocks B1, B2, . . . , BN are determined as (a21, a22, . . . , a2N), when sample grayscale is 128-grayscale, the correction values of the plurality of light-emitting blocks B1, B2, . . . , BN are determined as (a31, a32, . . . , a3N), and when sample grayscale is 192-grayscale, the correction values of the plurality of light-emitting blocks B1, B2, . . . , BN are determined as (a41, a42, . . . , a4N).

In the condition that the count value CV of the vertical blank section is equal to or greater than the second reference counting value CV2, when sample grayscale is 32-grayscale, the correction values of the plurality of light-emitting blocks B1, B2, . . . , BN are determined as (b11, b12, . . . , b1N), when sample grayscale is 64-grayscale, the correction values of the plurality of light-emitting blocks B1, B2, . . . , BN are determined as (b21, b22, . . . , b2N), when sample grayscale is 128-grayscale, the correction values of the plurality of light-emitting blocks B1, B2, . . . , BN are determined as (b31, b32, . . . , b3N), and when sample grayscale is 192-grayscale, the correction values of the plurality of light-emitting blocks B1, B2, . . . , BN are determined as (b41, b42, . . . , b4N). The second reference counting value CV2 may be larger than the first reference counting value CV1.

In the condition that the count value CV of the vertical blank section is equal to or greater than the third reference counting value CV3, when sample grayscale is 32-grayscale, the correction values of the plurality of light-emitting blocks B1, B2, . . . , BN are determined as (c11, c12, . . . , c1N), when sample grayscale is 64-grayscale, the correction values of the plurality of light-emitting blocks B1, B2, . . . , BN are determined as (c21, c22, . . . , c2N), when sample grayscale is 128-grayscale, the correction values of the plurality of light-emitting blocks B1, B2, . . . , BN are determined as (c31, c32, . . . , c3N), and when sample grayscale is 192-grayscale, the correction values of the plurality of light-emitting blocks B1, B2, . . . , BN are determined as (c41, c42, . . . , c4N).

In the condition that the count value CV of the vertical blank section is equal to or greater than the fourth reference counting value CV4, when sample grayscale is 32-grayscale, the correction values of the plurality of light-emitting blocks B1, B2, . . . , BN are determined as (d11, d12, . . . , d1N), when sample grayscale is 64-grayscale, the correction values of the plurality of light-emitting blocks B1, B2, . . . , BN are determined as (d21, d22, . . . , d2N), when sample grayscale is 128-grayscale, the correction values of the plurality of light-emitting blocks B1, B2, . . . , BN are determined as (d31, d32, . . . , d3N), and when sample grayscale is 192-grayscale, the correction values of the plurality of light-emitting blocks B1, B2, . . . , BN are determined as (d41, d42, . . . , d4N).

In this manner, the second lookup table 234 may store the correction values of the sampled light-emitting blocks.

The calculator 235 calculates the plurality of correction values of the plurality of light-emitting blocks B1, B2, B3, . . . , BN according to the counting value of the vertical blank period in the frame based on the correction values stored in the second lookup table 234.

Figure 11:
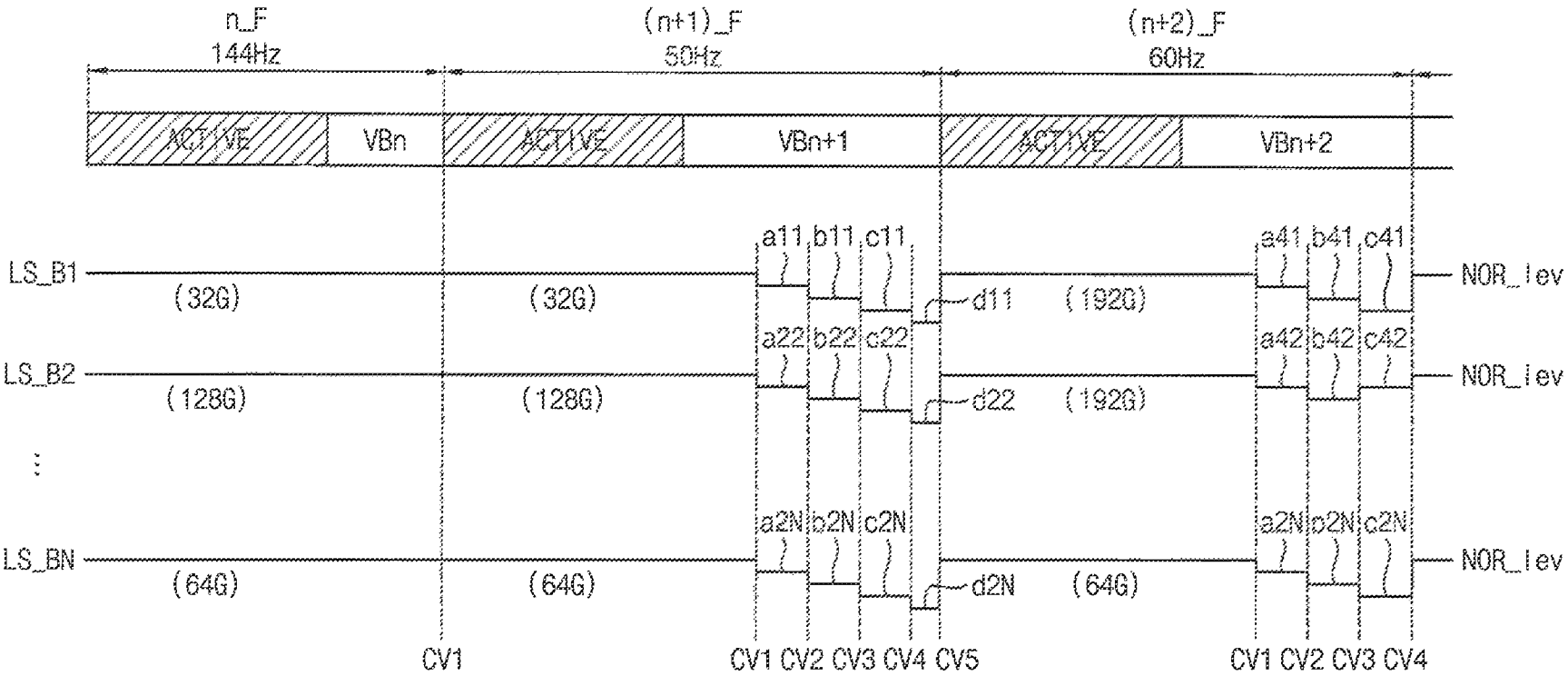
FIG. 11 is a conceptual diagram illustrating a plurality of light source driving signals of a plurality of light-emitting blocks according to an exemplary embodiment.

FIG. 11 is a conceptual diagram illustrating a plurality of light source driving signals of a plurality of light-emitting blocks according to an exemplary embodiment.

Referring to FIGS. 9, 10 and 11, when an n-th frame n_F is received, the VB detector 210 counts a data enable signal or a clock signal of the n-th vertical blank period VBn.

The histogram analyzer 233 calculates a first representative grayscale (32 G) corresponding to a first light-emitting block B1, a second representative grayscale (128 G) corresponding to the second light-emitting block B2, and an N-th representative grayscale (64 G) corresponding to an N-th light-emitting block BN.

Referring to the second lookup table 234 shown in FIG. 10, the calculator 235 compares the counting value CV with the first reference counting value CV1 and calculates the normal luminance value NOR_lev. For example, the calculator 235 calculates the normal luminance value NOR_lev corresponding to the first representative grayscale (32 G) for the first light-emitting block B1, calculates the normal luminance value NOR_lev corresponding to the second representative grayscale (128 G) for the second light-emitting block B1, and calculates the normal luminance value NOR_lev corresponding to the N-th representative grayscale (64 G) for the N-th light-emitting block BN.

The light source driver 600 generates a plurality of light source driving signals LS_B1, LS_B2, . . . , LS_BN corresponding to the n-th frame n_F.

The plurality of light source driving signals LS_B1, LS_B2, . . . , LS_BN have a normal level corresponding to the normal luminance value NOR_lev during the n-th vertical blank period VBn of the n-th frame n_F.

Then, when an (n+1)-th frame (n+1)_F is received, the VB detector 210 counts a data enable signal or a clock signal of the (n+1)-th vertical blank period VBn+1.

The histogram analyzer 233 calculates a first representative grayscale (32 G) corresponding to a first light-emitting block B1, a second representative grayscale (128 G) corresponding to the second light-emitting block B2, and an N-th representative grayscale (64 G) corresponding to an N-th light-emitting block BN.

Referring to the second lookup table 234 shown in FIG. 10, the calculator 235 calculates a first correction value a11, a second correction value b11, a third correction value c11 and a fourth correction value d11 corresponding to the first representative grayscale (32 G) among the correction values according to the comparison result of the counting value CV with the plurality of reference counting values CV1, CV2, CV3, CV4 and CV5 with respect to the first light-emitting block B1. The calculator 235 calculates a first correction value a22, a second correction value b22, a third correction value c22 and a fourth correction value d22 corresponding to the second representative grayscale (128 G) among the correction values according to the comparison result of the counting value CV with the plurality of reference counting values CV1, CV2, CV3, CV4 and CV5 with respect to the second light-emitting block B2. The calculator 235 calculates a first correction value a2N, a second correction value b2N, a third correction value c2N and a fourth correction value d2N corresponding to the N-th representative grayscale (64 G) among the correction values according to the comparison result of the counting value CV with the plurality of reference counting values CV1, CV2, CV3, CV4 and CV5 with respect to the N-th light-emitting block BN.

The light source driver 600 generates a plurality of light source driving signals LS_B1, LS_B2, . . . , LS_BN corresponding to the (n+1)-th frame (n+1)_F.

For example, the first light source driving signal LS_B1 has a normal level NOR_lev during the (n+1)-th active period, and a normal level NOR_lev, a first correction level a11, a second correction level b11, a third correction level c11 and a fourth correction level d11 during the (n+1)-th vertical blank period VBn+1. The second light source driving signal LS_B2 has a normal level NOR_lev during the (n+1)-th active period, and a normal level NOR_lev, a first correction level a22, a second correction level b22, a third correction level c22 and a fourth correction level d22 during the (n+1)-th vertical blank period VBn+1. The N-th light source driving signal LS_BN has a normal level NOR_lev during the (n+1)-th active period, and a normal level NOR_lev, a first correction level a2N, a second correction level b2N, a third correction level c2N and a fourth correction level d2N during the (n+1)-th vertical blank period VBn+1.

Then, when an (n+2)-th frame (n+2)_F is received, the VB detector 210 counts a data enable signal or a clock signal of the (n+2)-th vertical blank period VBn+2.

The histogram analyzer 233 calculates a first representative grayscale (192 G) corresponding to a first light-emitting block B1, a second representative grayscale (192 G) corresponding to the second light-emitting block B2, and an N-th representative grayscale (64 G) corresponding to an N-th light-emitting block BN.

Referring to the second lookup table 234 shown in FIG. 10, the calculator 235 calculates a first correction value a41, a second correction value b41 and a third correction value c41 corresponding to the first representative grayscale (192 G) among the correction values according to the comparison result of the counting value CV with the plurality of reference counting values CV1, CV2, CV3, CV4 and CV5 with respect to the first light-emitting block B1. The calculator 235 calculates a first correction value a42, a second correction value b42 and a third correction value c42 corresponding to the second representative grayscale (192 G) among the correction values according to the comparison result of the counting value CV with the plurality of reference counting values CV1, CV2, CV3, CV4 and CV5 with respect to the second light-emitting block B2. The calculator 235 calculates a first correction value a2N, a second correction value b2N and a third correction value c2N corresponding to the N-th representative grayscale (64 G) among the correction values according to the comparison result of the counting value CV with the plurality of reference counting values CV1, CV2, CV3, CV4 and CV5 with respect to the N-th light-emitting block BN.

The light source driver 600 generates a plurality of light source driving signals LS_B1, LS_B2, . . . , LS_BN corresponding to the (n+2)-th frame (n+2)_F.

For example, the first light source driving signal LS_B1 has a normal level NOR_lev during the (n+2)-th active period, and a normal level NOR_lev, a first correction level a41, a second correction level b41 and a third correction level c41 during the (n+2)-th vertical blank period VBn+2. The second light source driving signal LS_B2 has a normal level NOR_lev during the (n+2)-th active period, and a normal level NOR_lev, a first correction level a42, a second correction level b42 and a third correction level c42 during the (n+2)-th vertical blank period VBn+2. The N-th light source driving signal LS_BN has a normal level NOR_lev during the (n+1)-th active period, and a normal level NOR_lev, a first correction level a2N, a second correction level b2N and a third correction level c2N during the (n+2)-th vertical blank period VBn+2.

According to an exemplary embodiment, the luminance difference of the image due to the change of the vertical blank period may be removed by correcting the luminance of the light generated from each of the plurality of light-emitting blocks according to the counting value of the vertical blank period. In addition, the luminance difference of the image may be corrected for each position by individually correcting the light of the plurality of light-emitting blocks. In addition, by correcting the luminance of a plurality of light-emitting blocks by grayscale, the luminance difference for each grayscale may be corrected.

Hereinafter, the same reference numerals are used to refer to the same or like parts as those previously described. For convenience of explanation, a further description of these parts may be omitted.

Figure 12:
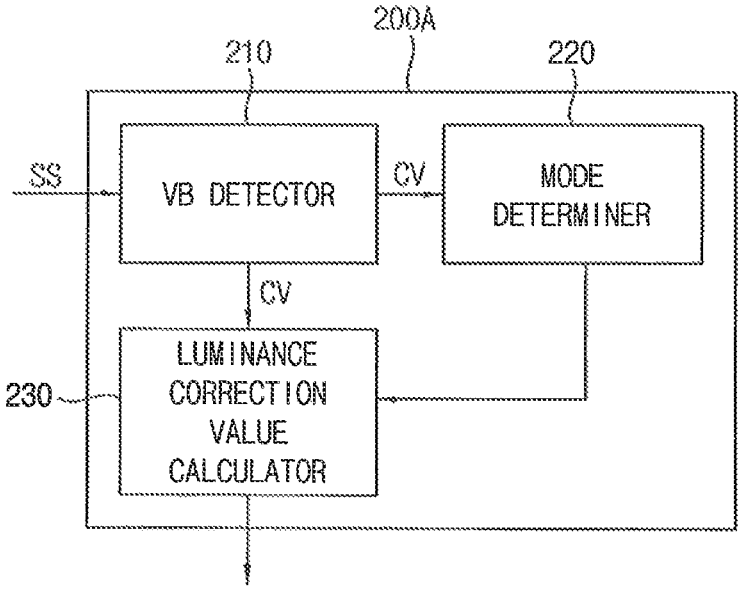
FIG. 12 is a block diagram illustrating a timing controller according to an exemplary embodiment.

FIG. 12 is a block diagram illustrating a timing controller according to an exemplary embodiment.

Referring to FIG. 12, the timing controller 200A may include a VB detector 210, a mode determiner 220 and a luminance correction value calculator 230. The VB detector 210, the mode determiner 220 and the luminance correction value calculator 230 may also be referred to herein as a VB detector circuit, a mode determiner circuit and a luminance correction value calculator circuit, respectively.

The VB detector 210 counts the data enable signal or a clock signal to calculate the counting value of a vertical blank period of the frame.

The mode determiner 220 compares the counting value of the vertical blank period with a mode reference value for M (M is a natural number) frames to determine whether the vertical blank period corresponds to an adaptive synchronous mode in which the vertical blank period is variable or a normal synchronous mode in which the vertical blank period is constant. As a result of the mode determination, the luminance correction value calculator 230 is enabled in the adaptive synchronous mode, and the operation of the luminance correction value calculator 230 is disabled in the normal synchronous mode.

The luminance correction value calculator 230 calculates a correction value for correcting the luminance of the light according to the counting value of the vertical blank period provided from the VB detector 210. In an exemplary embodiment, the luminance correction value calculator 230 may calculate the luminance correction value using the same driving method as that described with reference to FIGS. 4, 5, and 8. Alternatively, in an exemplary embodiment, the calculator 230 may calculate the luminance correction value using the same driving method as that described with reference to FIGS. 9, 10 and 11.

Figure 13:
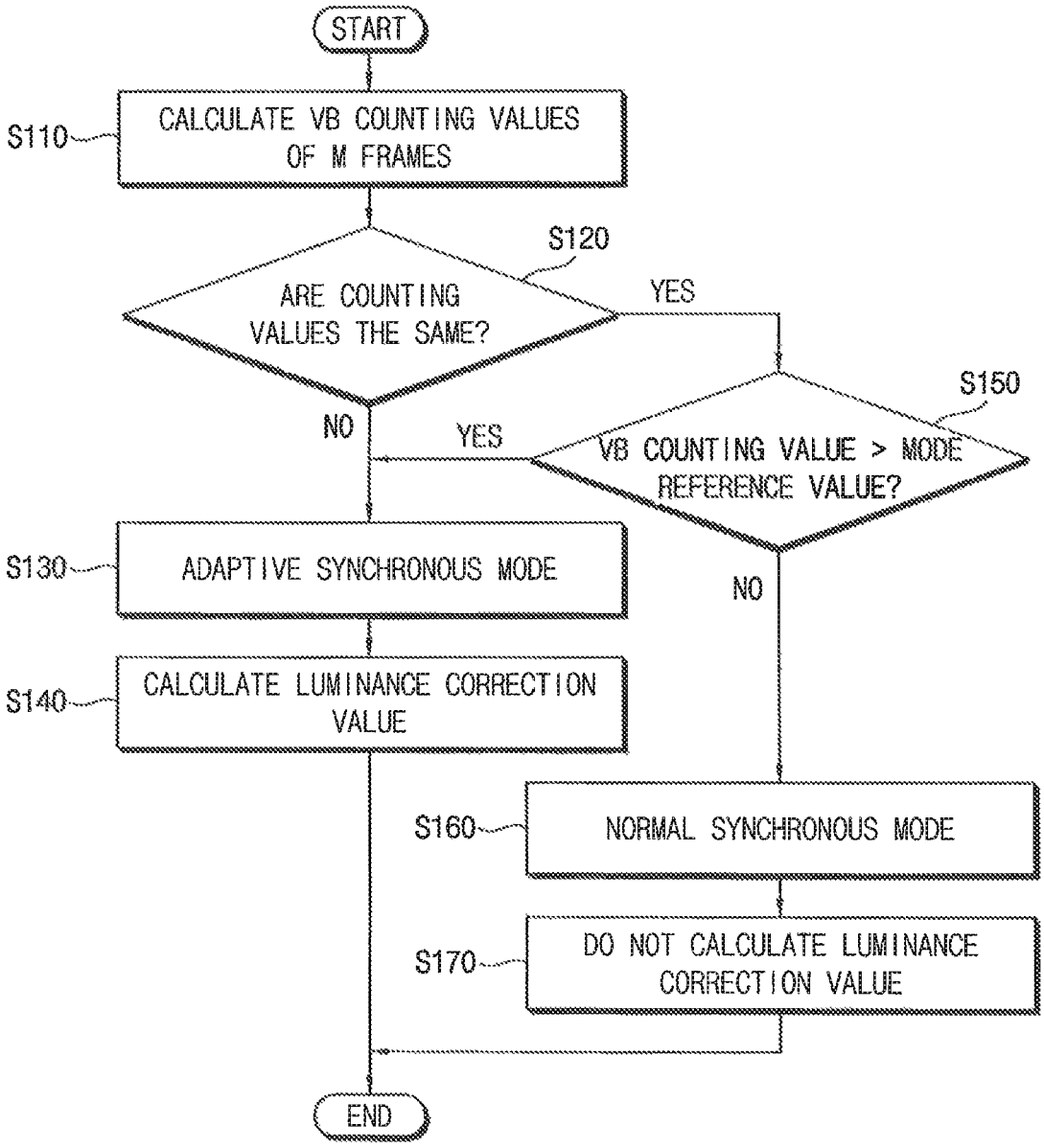
FIG. 13 is a flowchart illustrating a method of driving a display device including the timing controller of FIG. 12 according to an exemplary embodiment.

FIG. 13 is a flowchart illustrating a method of driving a display device including the timing controller of FIG. 12 according to an exemplary embodiment.

Referring to FIGS. 12 and 13, the VB detector 210 calculates counting values of M vertical blank periods corresponding to M frames (M is a natural number) in operation S110.

The mode determiner 220 compares the counting values of the M vertical blank periods with the mode reference value, and determines whether the counting values of the M vertical blank periods are the same in operation S120.

In operation S120, when the count values of M vertical blank periods are not equal, the mode determiner 220 determines the current frame to be displayed according to the adaptive synchronous mode in operation S130. The adaptive synchronous mode is a driving mode in which the vertical blank period of the frame and a frame frequency are variable.

The mode determiner 220 enables the luminance correction value calculator 230 to correct the luminance difference due to the variation of the vertical blank period in the adaptive synchronous mode.

The luminance correction value calculator 230 calculates the luminance correction value in operation S140. In an exemplary embodiment, the luminance correction value calculator 230 may calculate the luminance correction value using the same driving method as that described with reference to FIGS. 4, 5, and 8. Alternatively, the luminance correction value calculator 230 may calculate the luminance correction value using the same driving method as that described with reference to FIGS. 9, 10 and 11.

Referring again to operation S120, when the counter values of the M vertical blank periods are equal, the mode determiner 220 determines whether the counter values of the M vertical blank periods are greater than the mode reference value in operation S150.

In operation S150, when the counting values of the M vertical blank periods are greater than the mode reference value, the mode determiner 220 determines that the current frame is displayed according to the adaptive synchronous mode in operation S130, and calculates the luminance correction value in operation S140.

Alternatively, when the counting values of the M vertical blank periods are the same as or less than the mode reference value, the mode determiner 220 determines that the current frame is displayed according to the normal synchronous mode in operation S160. The normal synchronous mode is a constant driving mode with a frame frequency and a vertical blank period.

The mode determiner 220 disables the luminance correction value calculator 230 when the mode is the normal synchronous mode in operation S170.

According to exemplary embodiments of the inventive concept, by correcting the luminance level of the light according to the variation of the vertical blank interval, the luminance difference of the image due to the variation of the vertical blank interval may be eliminated or reduced. Further, the luminance level of the light may be corrected based on the grayscale of the image.

Exemplary embodiments of the inventive concept may be applied to a display device and an electronic device having the display device. For example, exemplary embodiments of the inventive concept may be applied to a computer monitor, a laptop, a digital camera, a cellular phone, a smartphone, a tablet computer, a television, a personal digital assistant (PDA), a portable multimedia player (PMP), an MP3 player, a navigation system, a game console, a video phone, etc.

As is traditional in the field of the inventive concept, exemplary embodiments are described, and illustrated in the drawings, in terms of functional blocks, units and/or modules. Those skilled in the art will appreciate that these blocks, units and/or modules are physically implemented by electronic (or optical) circuits such as logic circuits, discrete components, microprocessors, hard-wired circuits, memory elements, wiring connections, etc., which may be formed using semiconductor-based fabrication techniques or other manufacturing technologies. In the case of the blocks, units and/or modules being implemented by microprocessors or similar, they may be programmed using software (e.g., microcode) to perform various functions discussed herein and may optionally be driven by firmware and/or software. Alternatively, each block, unit and/or module may be implemented by dedicated hardware, or as a combination of dedicated hardware to perform some functions and a processor (e.g., one or more programmed microprocessors and associated circuitry) to perform other functions. Also, each block, unit and/or module of the exemplary embodiments may be physically separated into two or more interacting and discrete blocks, units and/or modules without departing from the scope of the inventive concept. Further, the blocks, units and/or modules of the exemplary embodiments may be physically combined into more complex blocks, units and/or modules without departing from the scope of the inventive concept.

While the inventive concept has been particularly shown and described with reference to the exemplary embodiments thereof, it will be understood by those of ordinary skill in the art that various changes in form and detail may be made therein without departing from the spirit and scope of the inventive concept as defined by the following claims.

What is claimed is:

1. A liquid crystal display device, comprising:

a liquid crystal display panel;

a light source configured to provide the liquid crystal display panel with a light;

a vertical blank detector circuit configured to calculate a counting value of a vertical blank period of a frame by counting a synchronization signal;

a luminance correction value calculator circuit configured to calculate a luminance correction value by comparing the counting value of the vertical blank period with a plurality of reference counting values; and a light source driver configured to generate a light source driving signal and provide the light source driving signal to the light source, wherein the light source driving signal has a normal level corresponding to a normal luminance value in an active period of the frame and has a correction level corresponding to the luminance correction value in the vertical blank period of the frame.

2. The liquid crystal display device of claim 1, wherein the luminance correction value calculator circuit is configured to sequentially compare the counting value of the vertical blank period with the plurality of reference counting values, and sequentially calculate the luminance correction value when the counting value of the vertical blank period is equal to or greater than one of the reference counting values.

3. The liquid crystal display device of claim 1, wherein the luminance correction value calculator circuit is configured to maintain the normal luminance value corresponding to the active period of the frame when the counting value of the vertical blank period is smaller than a smallest reference counting value of the vertical blank period.

4. The liquid crystal display device of claim 1, wherein the luminance correction value calculator circuit is configured to change to the normal luminance value corresponding to the active period of a next frame when a start signal corresponding to the next frame rises.

5. The liquid crystal display device of claim 1, wherein the plurality of reference counting values corresponds to counting values of a plurality of different vertical blank periods.

6. The liquid crystal display device of claim 1, wherein the light source comprises a plurality of light-emitting blocks, wherein the light source driver is configured to generate a plurality of light source driving signals and provide the plurality of light source driving signals to the plurality of light-emitting blocks.

7. The liquid crystal display device of claim 6, wherein the luminance correction value calculator circuit is configured calculate a plurality of luminance correction values for the plurality of light-emitting blocks by comparing the counting value of the vertical blank period with the plurality of reference counting values, wherein the plurality of light source driving signals have the normal level corresponding to the normal luminance value preset for each light-emitting block in the active period and a luminance level corresponding to one of the luminance correction values in the vertical blank period.

8. The liquid crystal display device of claim 6, further comprising:

a histogram analyzer circuit configured to analyze image data of a plurality of display blocks corresponding to the plurality of light-emitting blocks, and calculate a representative grayscale for each display block.

9. The liquid crystal display device of claim 6, wherein the luminance correction value calculator circuit is configured to calculate a luminance correction value for each light-emitting block based on the representative grayscale.

10. The liquid crystal display device of claim 1, further comprising:

a mode determiner circuit configured to determine whether a current frame is displayed according to an adaptive synchronous mode or a normal synchronous mode by comparing counting values of a plurality of vertical blank periods corresponding to a plurality of frames with a reference value, wherein the vertical blank period is variable in the adaptive synchronous mode and the vertical blank period is constant in the normal synchronous mode.

11. A method of driving a liquid crystal display device, comprising:

calculating a counting value of a vertical blank period in a frame by counting a synchronization signal;

calculating a luminance correction value by comparing the counting value of the vertical blank period with a plurality of reference counting values; and generating a light source driving signal having a normal level corresponding to a normal luminance value in an active period of the frame and having a correction level corresponding to the luminance correction value in the vertical blank period of the frame.

12. The method of claim 11, further comprising:

sequentially comparing the counting value of the vertical blank period with the plurality of reference counting values; and sequentially calculating the luminance correction value when the counting value of the vertical blank period is equal to or greater than one of the reference counting values.

13. The method of claim 11, further comprising:

maintaining the normal luminance value corresponding to the active period of the frame when the counting value of the vertical blank period is smaller than a smallest reference counting value of the vertical blank period.

14. The method of claim 11, further comprising:

changing to the normal luminance value corresponding to the active period of a next frame when a start signal corresponding to the next frame rises.

15. The method of claim 11, wherein the plurality of reference counting values corresponds to counting values of a plurality of different vertical blank periods.

16. The method of claim 11, further comprising:

generating a plurality of light source driving signals; and providing the plurality of light source driving signals to a plurality of light-emitting blocks.

17. The method of claim 16, further comprising:

calculating a plurality of luminance correction values for the plurality of light-emitting blocks by comparing the counting value of the vertical blank period with the plurality of reference counting values, wherein the plurality of light source driving signals have the normal level corresponding to the normal luminance value preset for each light-emitting block in the active period and a luminance level corresponding to one of the luminance correction values in the vertical blank period.

18. The method of claim 16, further comprising:

analyzing image data of a plurality of display blocks corresponding to the plurality of light-emitting blocks; and calculating a representative grayscale for each display block.

19. The method of claim 16, further comprising:

calculating a luminance correction value for each light-emitting block based on the representative grayscale.

20. The method of claim 16, further comprising:

determining whether a current frame is displayed according to an adaptive synchronous mode or a normal synchronous mode by comparing counting values of a plurality of vertical blank periods corresponding to a plurality of frames with a reference value, wherein the vertical blank period is variable in the adaptive synchronous mode and the vertical blank period is constant in the normal synchronous.

* * * * *